US010386108B2

(12) United States Patent
Seo et al.

(10) Patent No.: US 10,386,108 B2
(45) Date of Patent: Aug. 20, 2019

(54) REFRIGERATOR HAVING OUTER CASE AND INNER CASE FOR DISTRIBUTING COOL AIR

(71) Applicant: LG ELECTRONICS INC., Seoul (KR)

(72) Inventors: Hyunwoo Seo, Seoul (KR); Sanghwan Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 2 days.

(21) Appl. No.: 15/248,096

(22) Filed: Aug. 26, 2016

(65) Prior Publication Data

US 2017/0059229 A1 Mar. 2, 2017

(30) Foreign Application Priority Data

Aug. 26, 2015 (KR) ..... 10-2015-0120181

(51) Int. Cl.
*F25D 23/06* (2006.01)
*F25D 17/06* (2006.01)
(Continued)

(52) U.S. Cl.
CPC ..... *F25D 17/065* (2013.01); *F25B 39/00* (2013.01); *F25D 17/062* (2013.01); *F25D 23/063* (2013.01); *F25D 23/064* (2013.01); *F25D 23/068* (2013.01); *F25B 39/02* (2013.01); *F25D 23/066* (2013.01); *F25D 2201/126* (2013.01); *F25D 2317/063* (2013.01); *F25D 2317/067* (2013.01)

(58) Field of Classification Search
CPC .... F25D 23/061; F25D 23/063; F25D 23/064; F25D 23/066; F25D 23/067; F25D 23/068; F25D 2201/126; F25D 2201/2317; F25D 2201/0664; F25D 2201/0665; F25D 2201/0671
See application file for complete search history.

(56) References Cited

U.S. PATENT DOCUMENTS 2,285,947 A 6/1942 Sateren
2,310,117 A 2/1943 Reeves
(Continued)

FOREIGN PATENT DOCUMENTS

CN 101680707 3/2010
CN 104380020 2/2015
(Continued)

OTHER PUBLICATIONS

Partial European Search Report in European Application No. 16185444.3, dated Jan. 31, 2017, 8 pages (with English translation).
(Continued)

*Primary Examiner* — Edward F Landrum
*Assistant Examiner* — Daniel C Comings
(74) *Attorney, Agent, or Firm* — Fish & Richardson P.C.

(57) ABSTRACT

A refrigerator includes an outer case. The refrigerator further includes an inner case that is located in the outer case and that defines a storage space. The refrigerator further includes a metal plate that is coupled to inner surfaces of an upper portion and both sides of the inner case and that includes a front end that is spaced apart from a front end of the inner case a first distance.

22 Claims, 27 Drawing Sheets

(51) Int. Cl.

| | |
|---|---|
| ***F25B 39/00*** | (2006.01) |
| *F25B 39/02* | (2006.01) |

(56) References Cited

U.S. PATENT DOCUMENTS

| | | | | |
|---|---|---|---|---|
| 2,432,042 | A | 12/1947 | Richard | |
| 2,957,320 | A | 10/1960 | Armentrout | |
| 3,440,308 | A | 4/1969 | Carbary et al. | |
| 3,872,688 | A | 3/1975 | Tillman | |
| 4,369,632 | A | 1/1983 | Abraham | |
| 5,784,896 | A | 7/1998 | Tronnes et al. | |
| 6,422,031 | B1 | 7/2002 | Mandel et al. | |
| 9,861,213 | B2 * | 1/2018 | Goch | A47F 3/0452 |
| 2001/0003248 | A1 | 6/2001 | Otto et al. | |
| 2010/0251748 | A1 * | 10/2010 | Park | F25D 17/065 62/407 |
| 2014/0139087 | A1 * | 5/2014 | Tobbe | F25D 23/064 312/400 |
| 2016/0273828 | A1 * | 9/2016 | Burke | A47B 96/025 |

FOREIGN PATENT DOCUMENTS

| | | | |
|---|---|---|---|
| EP | 1174666 | A2 | 1/2002 |
| EP | 2865973 | | 4/2015 |
| FR | 2639424 | | 5/1990 |
| JP | S61-006172 | | 1/1986 |
| JP | 08061824 | A2 | 8/1996 |
| JP | 11101573 | A2 | 4/1999 |
| JP | 2001108359 | A2 | 4/2001 |
| JP | 2003-083664 | | 3/2003 |
| JP | 2007030951 | A2 | 2/2007 |
| JP | 2007064536 | A2 | 3/2007 |
| JP | 04093973 | A2 | 6/2008 |
| KR | 10-2008-0087326 | | 10/2008 |
| KR | 10-2009-0080618 | | 7/2009 |
| KR | 2014009647 | A2 | 1/2014 |

OTHER PUBLICATIONS

Extended European Search Report in European Application No. 16185444.3, dated May 16, 2017, 16 pages (with English translation).

CN Office Action in Chinese Application No. 201610730844.0, dated Jul. 24, 2018, 22 pages (with English Translation).

Extended European Search Report in European Application No. 17203206.2, dated Apr. 6, 2018, 10 pages.

* cited by examiner

REFRIGERATOR HAVING OUTER CASE AND INNER CASE FOR DISTRIBUTING COOL AIR

CROSS-REFERENCE TO RELATED APPLICATION

This application claims priority under 35 U.S.C. § 119 and 35 U.S.C. § 365 to Korean Patent Application No. 10-2015-0120181, filed in Korea on Aug. 26, 2015, whose entire disclosure is hereby incorporated by reference.

FIELD

This application relates to a refrigerator.

BACKGROUND

Generally, a refrigerator is divided into a refrigerator compartment and a freezer compartment.

To preserve cooling air in the refrigerator compartment and the freezer compartment, a door is installed at a front surface of the refrigerator. And an inside of the refrigerator, in particular, an accommodation space like the refrigerator compartment is characterized in that the cooling air should be circulated therein for a long time.

SUMMARY

According to an innovative aspect of the subject matter described in this application, a refrigerator includes: an outer case; an inner case that is located in the outer case and that defines a storage space; and a metal plate that is coupled to inner surfaces of an upper portion and both sides of the inner case and that includes a front end that is spaced apart from a front end of the inner case a first distance.

The refrigerator may include one or more of the following optional features. The front end of the inner case is spaced apart from the front end of the metal plate by the first distance of 12 to 40 mm. The refrigerator further includes an evaporator that is located in the inner case and that is configured to generate cool air; and a grille part that includes a front end that is connected to the inner surface of the upper portion of the inner case, and that includes a rear end that is connected to the front end of the metal plate. The inner case includes a first plate that includes an upper surface portion; two side surface portions that are each connected to a side of the upper surface portion; and a rear surface portion that is connected to a rear end of the upper surface portion. The inner case further includes a lower surface portion that is connected to a lower end of the rear surface portion and a lower end of the side surface portions. The metal plate is coupled to an inner surface of the upper surface portion and inner surfaces of the two side surface portions.

The metal plate includes an upper plate that is coupled to the inner surface of the upper surface portion; two side plates that include a first side plate that is coupled to the inner surface of a first of the two side surface portions; and a second side plate that is coupled to the inner surface of a second of the two side surface portions. The grille part is located at a lower surface of the inner surface of the upper portion of the inner case, is spaced apart from a front end of the upper surface portion, and is configured to distribute cool air generated by the evaporator to an inside of the inner case. The upper plate includes a first surface that is parallel to the upper surface portion; a first extending portion that is connected to a front end of the first surface and that is included in a same plate as the first surface; and a first front end portion that is connected to the first extending portion, that is parallel to the first surface, and that is included in the same plate as the first surface and the first extending portion. An upper surface of a rear end of the grille part is configured to support a lower surface of the first front end portion.

The refrigerator further includes a grille protrusion portion that defines a first groove located at a part of an outer circumferential surface of the grille protrusion portion, the grille protrusion portion being located at an upper surface of both sides of the grille part, and a grille fixing portion that defines a first protrusion located at an inner circumferential surface of the grille fixing portion, that is configured to insert into the first groove, and that is located at both sides of the upper surface portion, and based on the grille protrusion portion being inserted into the grille fixing portion, the first groove receives the first protrusion, and the grille part is coupled to a lower surface of the upper surface portion. The refrigerator further includes a rear duct that is located in front of and separated from the rear surface portion and that is configured to supply cool air generated by the evaporator to the inner case; and one or more upper ducts that include first ends that are coupled to an area spaced apart a predetermined distance from a front end of the upper surface portion, that include second ends that are coupled to a rear end of the upper surface portion, and that define path for supplying cool air into the inner case.

The upper surface portion defines one or more first duct coupling openings that are located at an area spaced apart a predetermined distance from a front end of the upper surface portion; and one or more second duct coupling openings that are located at a rear end of the upper surface portion and that are configured to receive cool air from the evaporator. One of the first ends or the second ends of the one or more upper ducts are coupled to the one or more first duct coupling openings. Another of the first ends or the second ends of the one or more upper ducts are coupled to the one or more second duct coupling openings. The inner case receives cool air from the one or more first duct coupling openings, a path of the upper duct, and the one or more second duct coupling openings. The grille part is located at a lower surface of the upper surface portion that defines the one or more first duct coupling openings, and is configured to receive cool air from the one or more first duct coupling openings. The upper surface portion includes a second plate that includes an upper surface; an upper surface bending portion that is connected to a rear end of the upper surface; and an upper surface rear end portion that extends back and horizontally from the upper surface bending portion.

An end of the upper surface portion is connected to the rear surface portion. The upper surface rear end portion defines the one or more second duct coupling openings. Each of the two side surface portions includes a recessed portion that is located at a part of an inner surface of the side surface portion and that is recessed a width from each of the side plates, and, based on the two side plates being coupled to the two side surface portions, respectively, the recessed portions receive the two side plates. Each of the two side plates includes a second surface that is parallel to the side surface portion; and a second front end portion that is connected to both ends of the second surface, that is parallel to the second surface, and that extends in a direction opposite the second surface. Based on the side plates being coupled to the side surface portions, a surface of the second front end portion contacts an inner surface of the recessed portion. The rear duct includes a metallic material, and defines discharge openings that are configured to discharge cool air.

According to another innovative aspect of the subject matter described in this application, a refrigerator includes an outer case; an inner case that is located in the outer case and that defines a storage space; and a metal plate that is coupled to inner surfaces of an upper portion and both sides of the inner case. The inner case defines a plurality of injection holes that are located at an upper portion of the inner case and that are configured to receive a foaming agent that is configured to fill a space between the upper portion of the inner case and an upper plate, and that is configured to attach the inner surface of the upper portion of the inner case to the upper plate.

The refrigerator may include one or more of the following implementations. Each of the plurality of injection holes is configured to receive the foaming agent and prevent discharge of the foaming agent. The inner case includes a first plate that includes an upper surface portion that defines the injection holes; two side surface portions that are each connected to a side of the upper surface portion; and a rear surface portion that is connected to a rear end of the upper surface portion. The inner case further includes a lower surface portion that is connected to a lower end of the rear surface portion and a lower end of the side surface portions. The metal plate includes an upper plate that is coupled to an inner surface of the upper surface portion; and two side plates that include a first side plate that is coupled to an inner surface of a first of the two side surface portions; and a second side plate that is coupled to an inner surface of a second of the two side surface portions. Both side ends of the upper plate support upper ends of the two side plates at lower sides of the two side plates.

The upper plate includes a first surface that is parallel to the upper surface portion; and a side end portion that is connected to both ends of the first surface, that is parallel to the first surface, and that extends in a direction opposite the first surface. Each of the side plates includes a second surface that is parallel to the side surface portion; and an upper end portion that is connected to an upper end of the second surface and that is shaped similarly to the side surface portion or the upper surface portion. An upper surface of the side end portion supports a part of a lower surface of the upper end portion. The upper end portion of the side plate includes a first upper end portion that extends from the second surface, a second upper end portion that defines a bending angle with an end of the first upper end portion, and a third upper end portion that extends from an end of the second upper end portion and that is parallel to a direction that the first upper end portion extends. The side end portion supports a lower surface of the third upper end portion.

The upper surface portion further defines one or more first coupling openings that are located at both sides of the upper surface portion; and one or more second coupling openings that are located at a rear end of the upper surface portion. The upper plate includes one or more first coupling ribs that protrude upward from both sides of the upper plate; and one or more second coupling ribs that are located at a rear end of the upper plate and that protrude upward. The first coupling rib includes a first protruding portion that protrudes upward from both sides of the upper plate; and a first bending portion defines a bending angle with the first protruding portion. Parts of the first protruding portion and the first bending portion define a predetermined angle toward a center of the upper plate. The second coupling rib includes a second protruding portion that protrudes upward from a rear end of the upper plate; and a second bending portion that defines a bending angle with the second protruding portion. A location between the second bending portion and the second protruding portion is flexible.

One or more third coupling openings are located on each of the two side surface portions and are spaced apart from front ends of the two side surface portions a predetermined distance. One or more first coupling grooves are located on the rear surface portion. Rear ends of the two side plates are located at an inner surface of the rear surface portion. Each of the side plates includes one or more third coupling ribs that protrude from one surface of the side plate and that are spaced apart from a front end of the side plate a predetermined distance; and one or more fourth coupling ribs that protrude backward from a rear end of the side plate. Each of the third coupling ribs includes a third protruding portion that protrudes outward from the front end of each of the side plates; and a third bending portion that defines a bending angle with the third protruding portion. A part of the third bending portion defines a predetermined angle with a remaining part of the third bending portion. Each of the fourth coupling ribs includes a fourth protruding portion that protrudes backward from the rear end of each of the side plates; and a fourth bending portion that extends from the fourth protruding portion and that is located in the first coupling groove. The fourth bending portion defines a predetermined angle with the fourth protruding portion.

DETAILED DESCRIPTION

Reference will now be made in detail to the implementations of the present disclosure, examples of which are illustrated in the accompanying drawings.

Also, terms such as first, second, A, B, (a), (b) or the like may be used herein. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
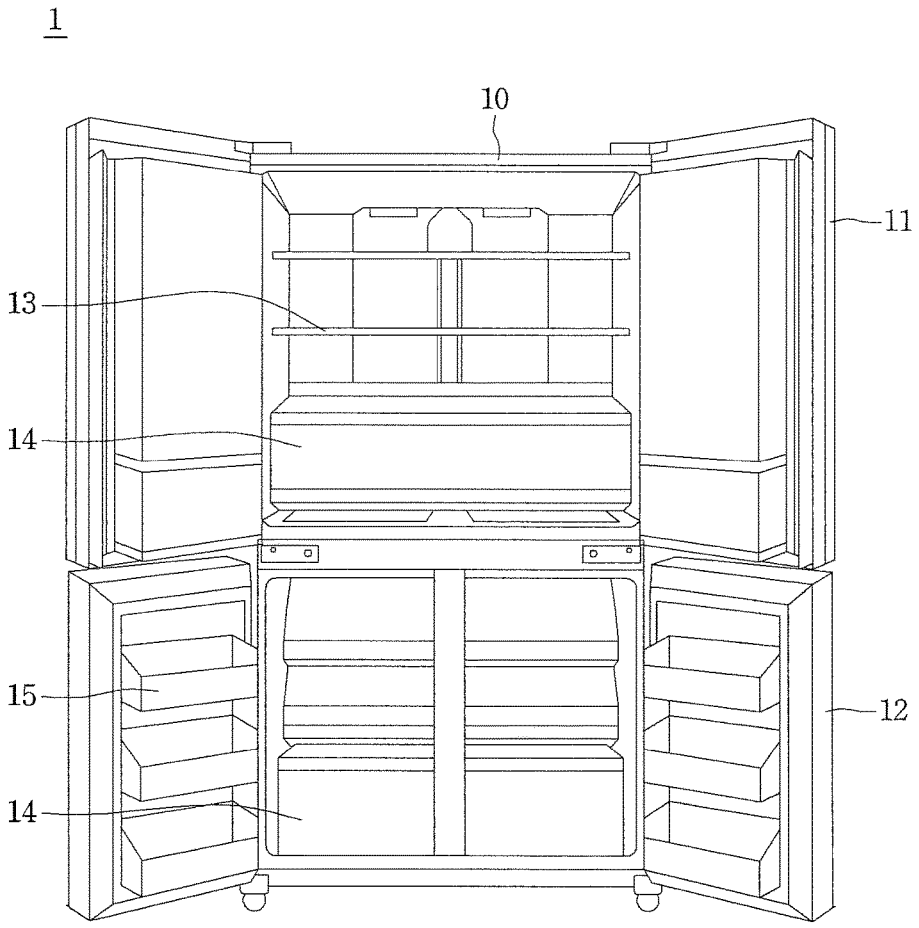
FIG. 1 is a front view of an example refrigerator.

FIG. 1 illustrates an example refrigerator.

Referring to FIG. 1, a refrigerator may include a main body 10 in which a storage compartment is formed, and a refrigerator compartment door 11 and a freezer compartment door 12 which are rotatably installed at both sides of the main body 10 to selectively open and close the storage compartment.

The storage compartment includes a freezer compartment for keeping a stored product frozen, and a refrigerator compartment for keeping the stored product refrigerated. The freezer compartment and the refrigerator compartment may be independently shielded by the freezer compartment door 12 and the refrigerator compartment door 11, respectively.

Also, one or more storage boxes 14 which are provided to be withdrawn to a front of the storage compartment may be formed at the main body 10, and the stored product such as vegetables and fruits may be stored in the storage boxes 14.

In the same manner, one or more shelves 13 which divide the storage compartment into a plurality of areas may be formed at the main body 10. The stored product may be stored in the storage compartment while being seated on the shelves 13.

A door basket 15 which accommodates the stored product may be provided at the freezer compartment door 12.

The refrigerator illustrated in the drawing is an example implementation. The door basket 15 may be provided at both sides of the refrigerator compartment door 11, and the storage boxes 14 and the shelves 13 may be provided at both of the freezer compartment and the refrigerator compartment.

Hereinafter, a configuration of the main body 10 of the refrigerator will be described in detail.

The main body 10 of the refrigerator will be described in detail.

Figure 2:
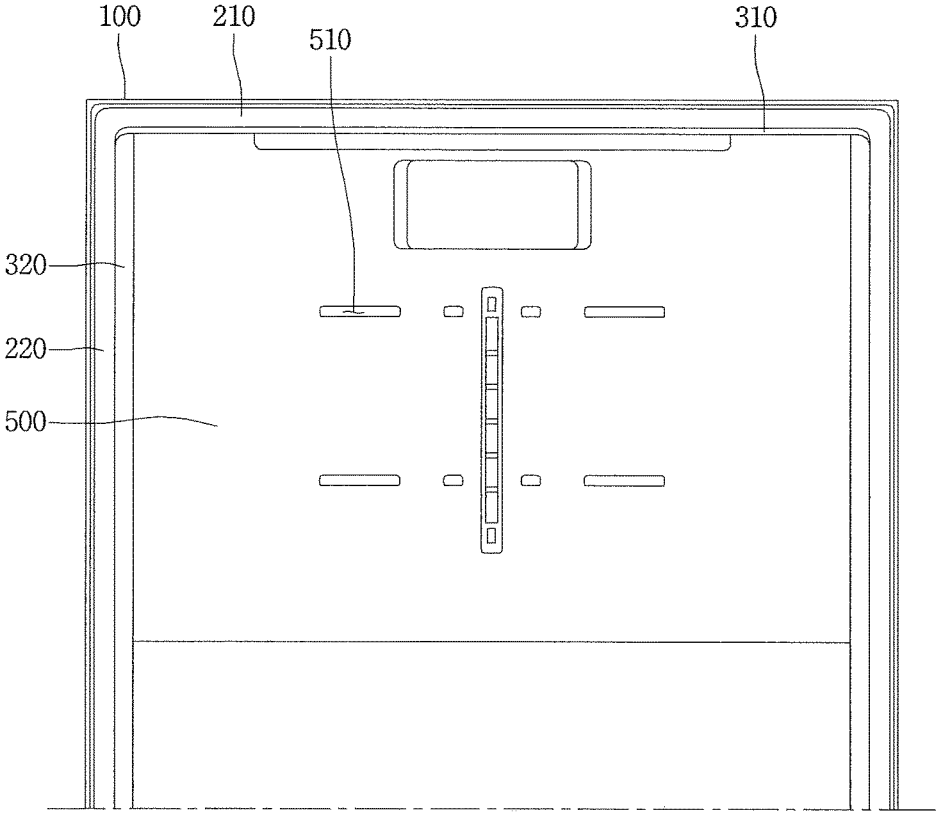
FIG. 2 is a front view of an example main body of a refrigerator.
Figure 3:
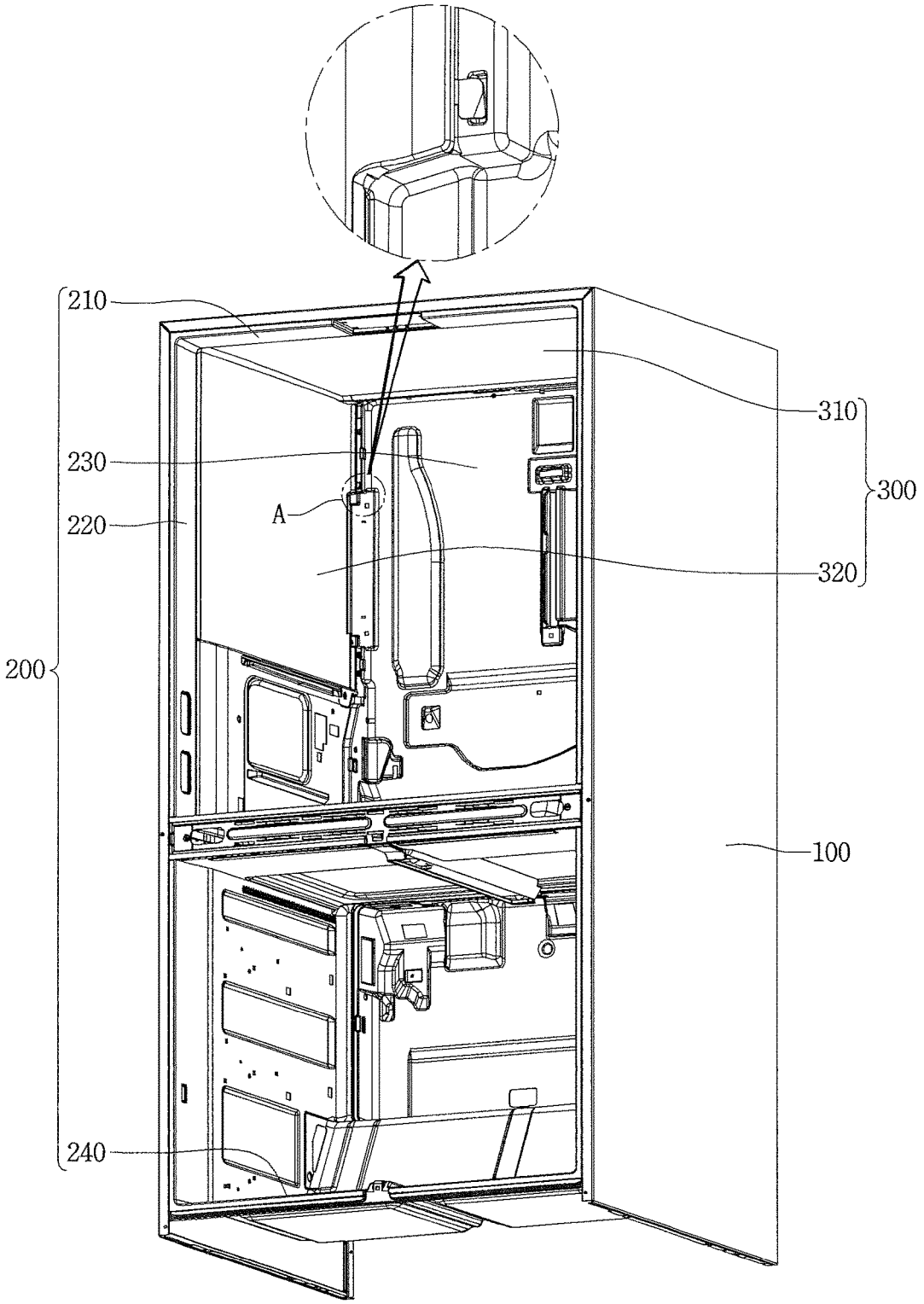
FIG. 3 is a perspective view of an example rear duct removed from a main body of a refrigerator.
Figure 4:
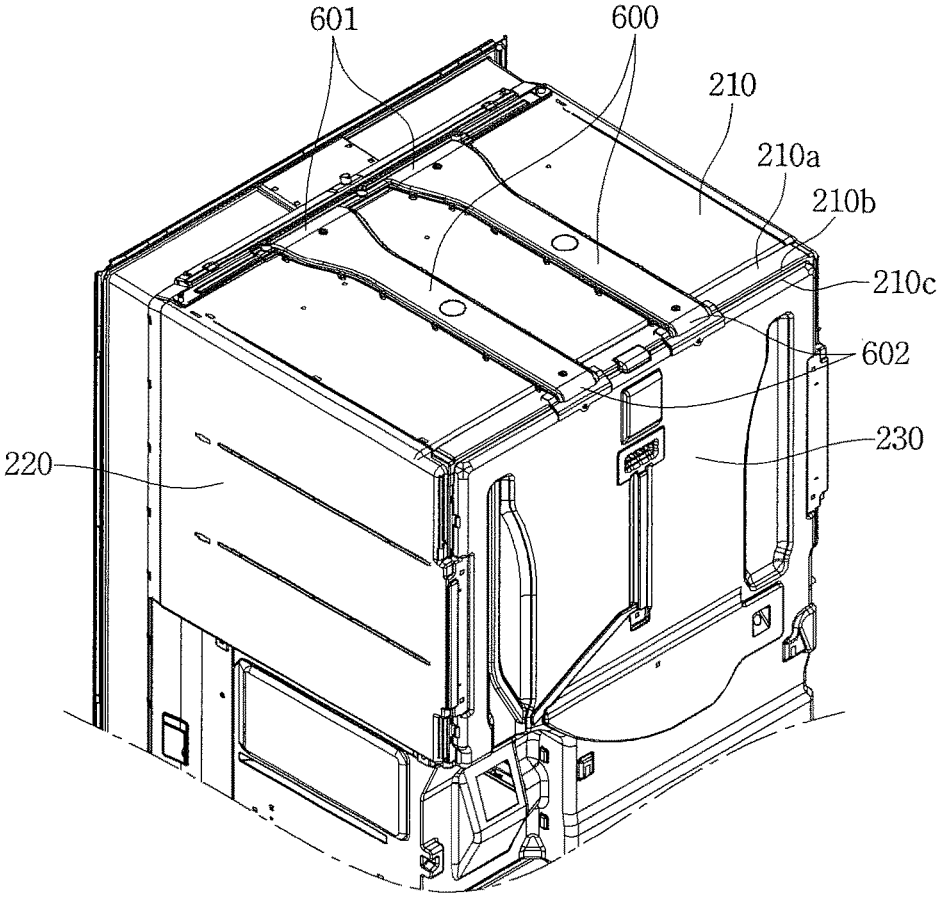
FIG. 4 is a rear perspective view of an example outer case removed from a refrigerator body.
Figure 5:
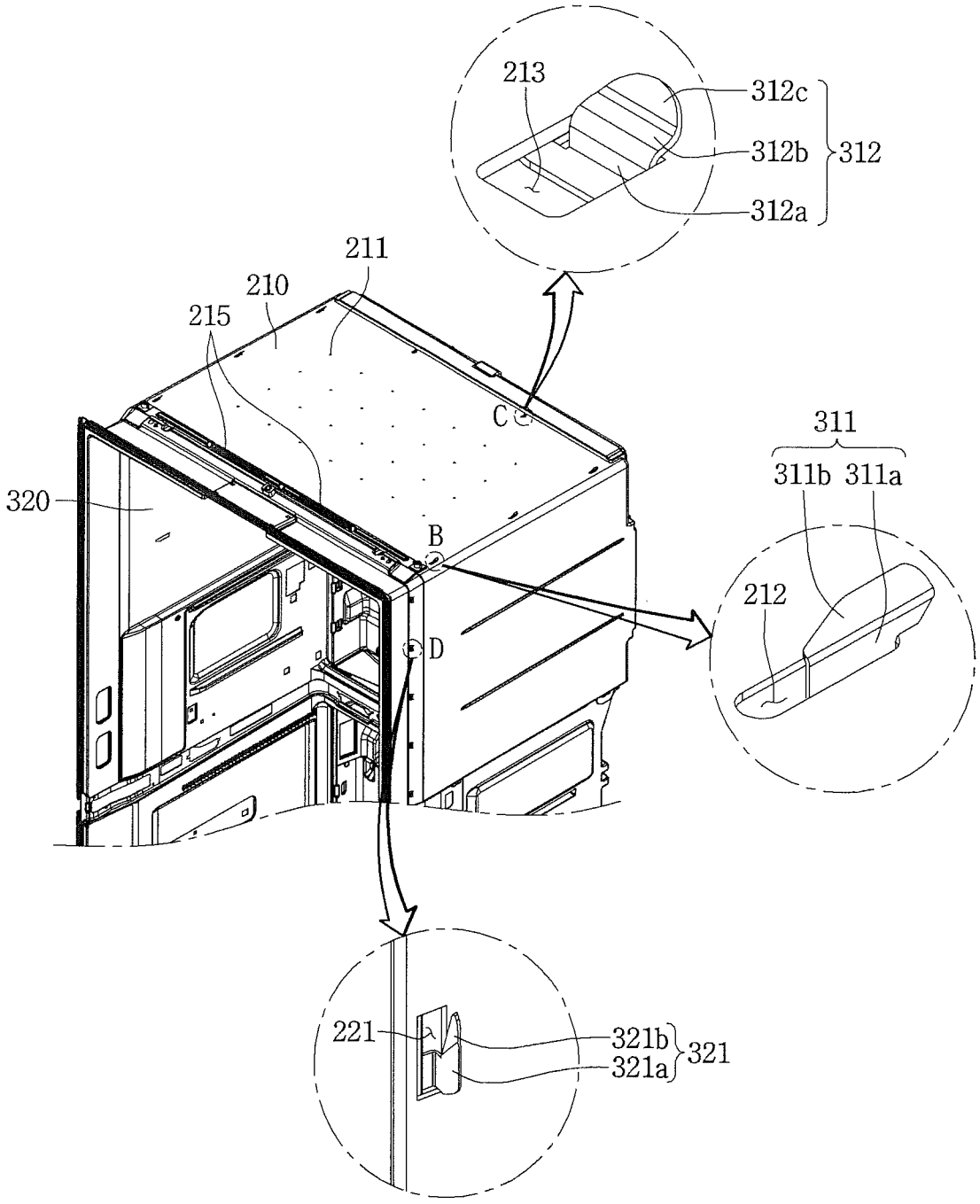
FIG. 5 is a front perspective view of an example upper duct removed from a refrigerator body.
Figure 6:
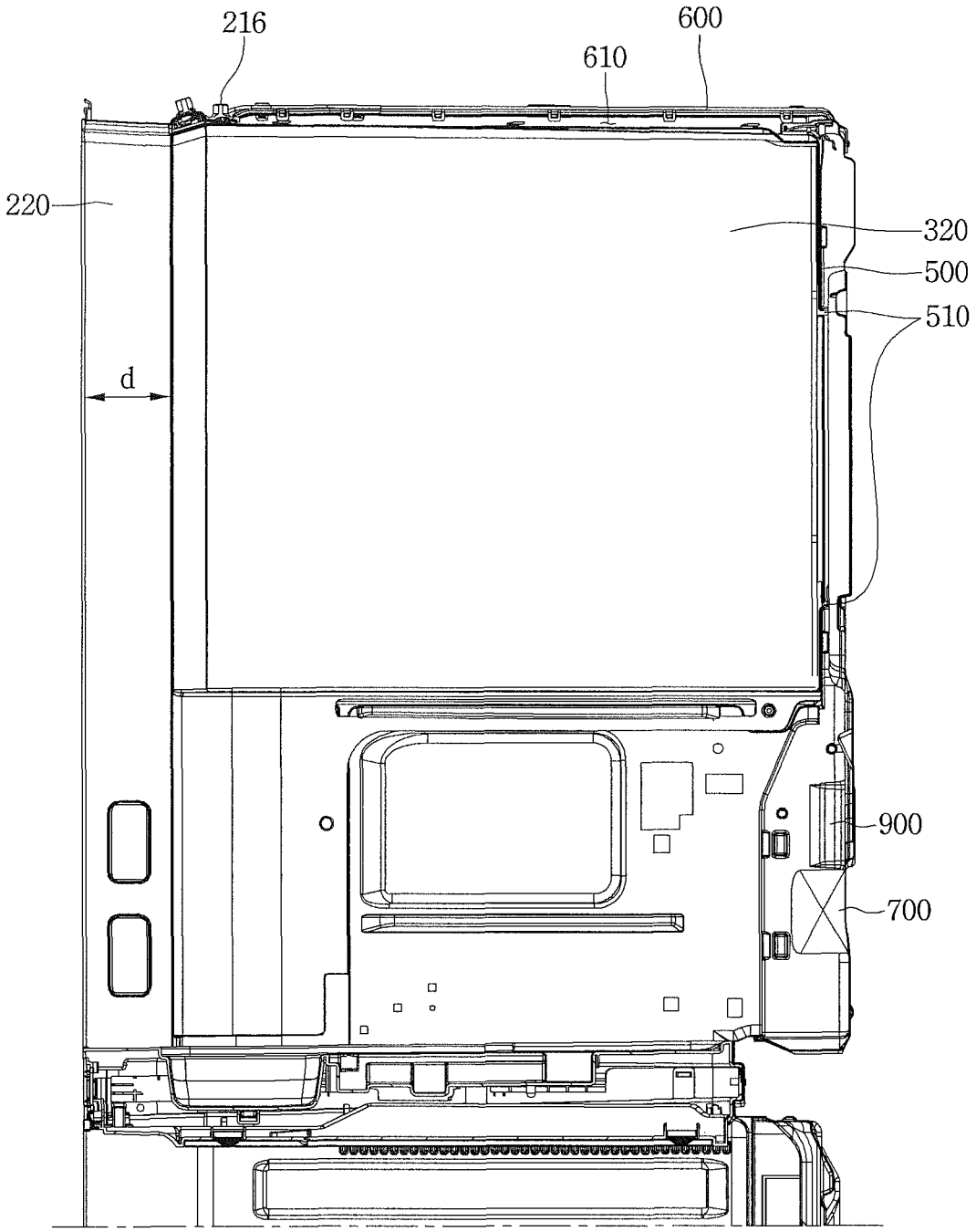
FIG. 6 is a side cross-sectional view of an example main body of a refrigerator.
Figure 7:
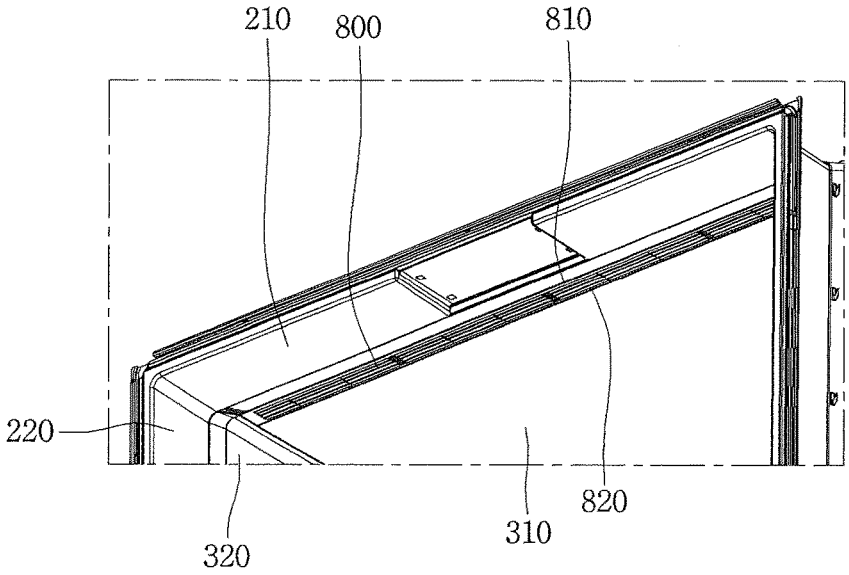
FIG. 7 is a view of an upper side of an inside of an example main body of a refrigerator.
Figure 8:
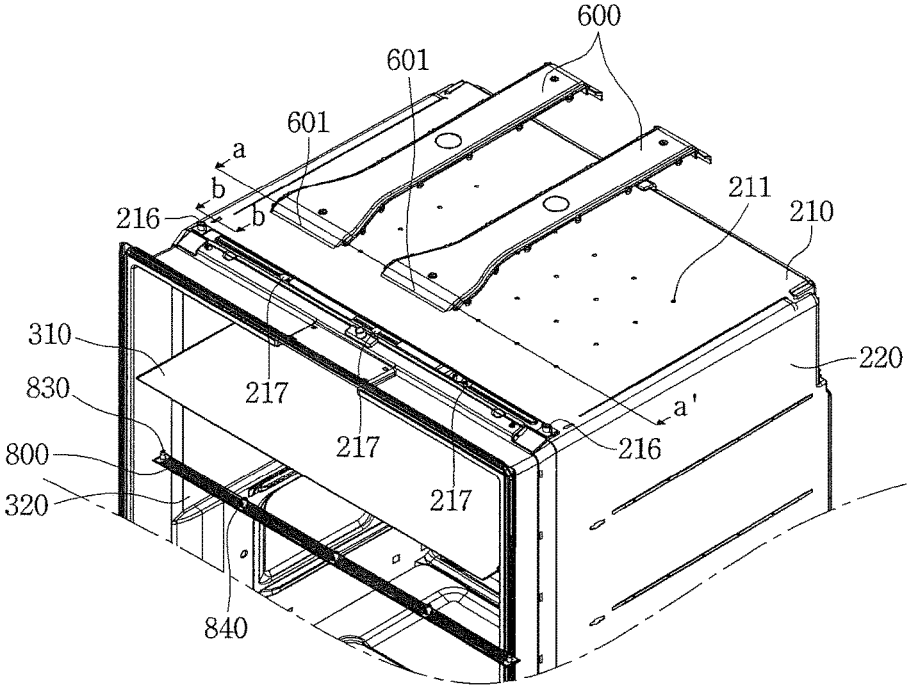
FIG. 8 is an exploded view of an example metal plate, an example upper duct, and an example grille part of a main body of a refrigerator.

FIGS. 2, 6, and 7 illustrate example main bodies of a refrigerator. FIG. 3 illustrates an example rear duct that is removed from a main body of a refrigerator. FIG. 4 illustrates an example outer case that is removed from a refrigerator body. FIG. 5 illustrates an example upper duct that is removed from a refrigerator body. FIG. 8 illustrates an example metal plate, an example upper duct, and an example grille part of a main body of a refrigerator.

Referring to FIGS. 2 to 8, the refrigerator may include an outer case 100 which forms an exterior of the main body 10, an inner case 200 which is formed inside the outer case 100, and a metal plate 300 which is attached to an inner surface of the inner case.

Also, the refrigerator may further include an evaporator 700 which is disposed between a rear surface of the inner case 200 and a rear surface of the outer case 100 to generate cooling air, a multi-fan 900 which is disposed at an upper portion of the evaporator 700 to provide an air flow to the cooling air generated from the evaporator 700 and thus to move the cooling air, an upper duct 600 which is connected to a front end and a rear end of an upper portion of the inner case 200 to supply the cooling air generated from the evaporator 700 to an inside through an upper surface of the inner case 200, a rear duct 500 which is disposed to be spaced apart from a rear inner surface of the inner case 200 at a predetermined distance and thus to supply the cooling air generated from the evaporator 700 to the inside of the inner case 200, and a grille part 800 which is disposed at an upper inner surface of the inner case 200.

The outer case 100 is a case which forms the exterior of the main body 10, and may be disposed at, for example, an outside of the inner case 200. Also, the outer case 100 is formed in a box shape, and the inner case 200 is disposed at an internal space thereof, and the refrigerator compartment door 11 and the freezer compartment door 12 may be formed at front surfaces of both side ends thereof.

The inner case 200 may be disposed inside the outer case 100, and may provide the refrigerator compartment and the freezer compartment, e.g., an inside of the refrigerator. In some implementations, the inner case 200 may include a partition wall which divides the inside of the refrigerator into the refrigerator compartment and the freezer compartment. Also, the inner case 200 may be formed in a box shape, of which a front surface is opened, through a plastic injection molding.

A protrusion or a groove for attaching a rail or the like at which the storage box 14 or the shelf 13 of the refrigerator is installed may be formed at the inner case 200. For example, the inner case 200 may be formed of an acrylonitrile-butadiene-styrene (ABS) resin. A detailed configuration of the inner case 200 will be described later.

The metal plate 300 may be coupled to the inner surface of the inner case 200. In some implementations, the metal plate 300 may be coupled to the upper and side inner surfaces of the inner case 200, and may be formed in a shape corresponding to that of the coupled inner surface of the inner case 200.

For example, when the protrusion or the groove to which the rail for coupling the door basket 15 or the shelf 13 is installed is formed at the inside of the inner case 200, a groove or a protruding corresponding to that may also be formed at the metal plate.

Also, the metal plate 300 may be a clad formed of stainless steel (STS). In some implementations, a front end of the metal plate 300 may be coupled to the upper and side inner surfaces of the inner case 200 located at positions which are spaced backward from the front end of the inner case 200 at a first distance d. When the front end of the metal plate 300 is coupled to the upper and side inner surfaces of the inner case 200 located at the positions which are spaced backward from the front end of the inner case 200 at the first distance d, a detailed coupling relationship and effect will be described later.

The evaporator 700 is disposed inside the inner case 200, and generates the cooling air which will be supplied into the refrigerator formed by the inner case 200. In some implementations, the evaporator 700 may be formed at an inner rear end of the inner case 200, and a shielding cover which covers the evaporator 700 not to be seen from an outside may be formed at a front of the evaporator 700.

Multi-fan 900 is disposed at the upper portion of the evaporator 700, and enables the cooling air generated from the evaporator 700 to be smoothly circuited in the inner case 200. The cooling air generated from the evaporator 700 may be supplied to the inside of the refrigerator formed by the inner case 200 through the upper duct 600 and the rear duct 500 which will be described below while being circulated through the multi-fan 900.

The upper duct 600 may be connected to upper front and rear ends of the inner case 200, and may supply the cooling air into an internal space of the inner case 200. In some implementations, the upper duct 600 may form a path, e.g., a flow path through which the cooling air flows.

Also, one end 601 of the upper duct 600 may be coupled to an upper certain position of the inner case 200 which is spaced apart from the front end of the inner case 200 in the first distance d, and the other end 602 thereof may be coupled to a certain position of the rear end of the inner case 200.

In some implementations, the cooling air generated from the evaporator 700 may be guided from the other end 602 of the upper duct 600 toward the one end 601 thereof through the flow path formed in the upper duct 600, and may be supplied into the internal space of the inner case 200. In the drawing and in some implementations, two upper ducts 600 are coupled to the upper portion of the inner case 200. If necessary, one or more upper ducts 600 may be coupled to the upper portion of the inner case 200.

The rear duct 500 may be disposed at the rear inner surface of the inner case 200, and may supply the cooling air generated from the evaporator 700 into the inside of the inner case 200. In some implementations, the rear duct 500 may be spaced apart from the rear inner surface of the inner case 200 at a predetermined distance, and the cooling air circulated in a spaced space may be supplied into the inside the inner case 200.

Also, the rear duct 500 may be formed of a metallic material to enhance a visual beauty effect together with the metal plate 300 and also to maintain a capacity of retaining the cooling air for a long time.

Also, one or more discharge openings 510 through which the cooling air flowing at a rear of the rear duct 500 is supplied into the inside of the inner case 200 may be formed at the rear duct 500.

The grille part 800 may be disposed at the upper inner surface of the inner case 200. In some implementations, a front end 810 of the grille part 800 may be connected to the upper inner surface of the inner case 200, and a rear end 820 thereof may be connected to the front end of the metal plate 300, and thus the cooling air supplied through the upper duct 600 may be distributed to the internal space of the inner case 200.

Also, the grille part 800 may be formed so that a plurality of grilles which extends in a long side direction are coupled to a long bar-shaped frame forming a border thereof. The grille part 800 may include two first grille protrusion portions 830 which protrude upward from upper surfaces of both sides of the grille part 800, and second grille protrusion portions 840 which protrude upward between the two first grille protrusion portions 830 so as to be spaced apart at regular intervals. Description of a coupling relationship between the grille part 800 and the inner case 200 will be provided later in detail.

Hereinafter, each configuration of the inner case 200 and the metal plate 300 will be described in detail.

Figure 9:
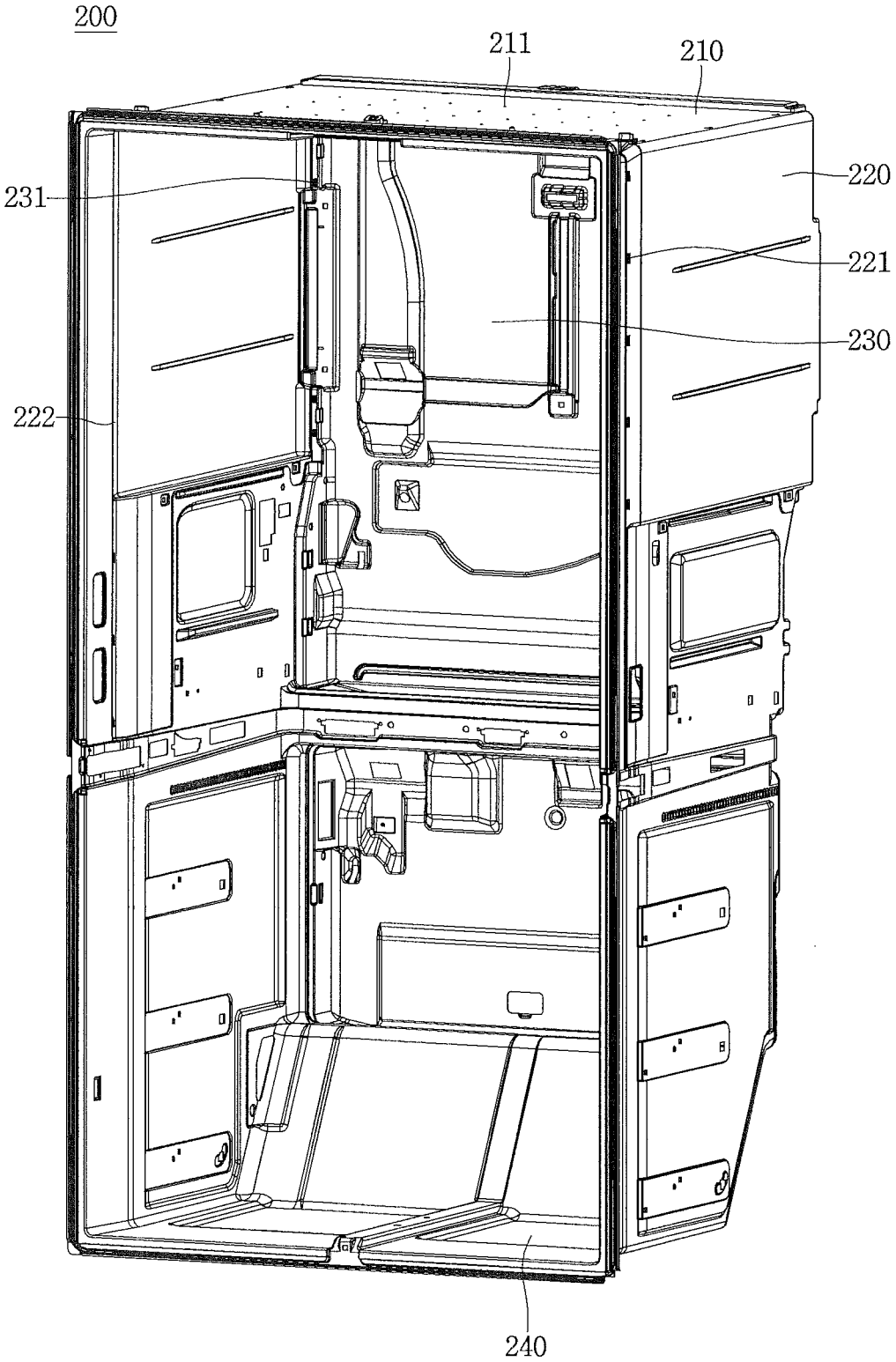
FIG. 9 is a perspective view of an example inner case in a main body of a refrigerator.
Figure 10:
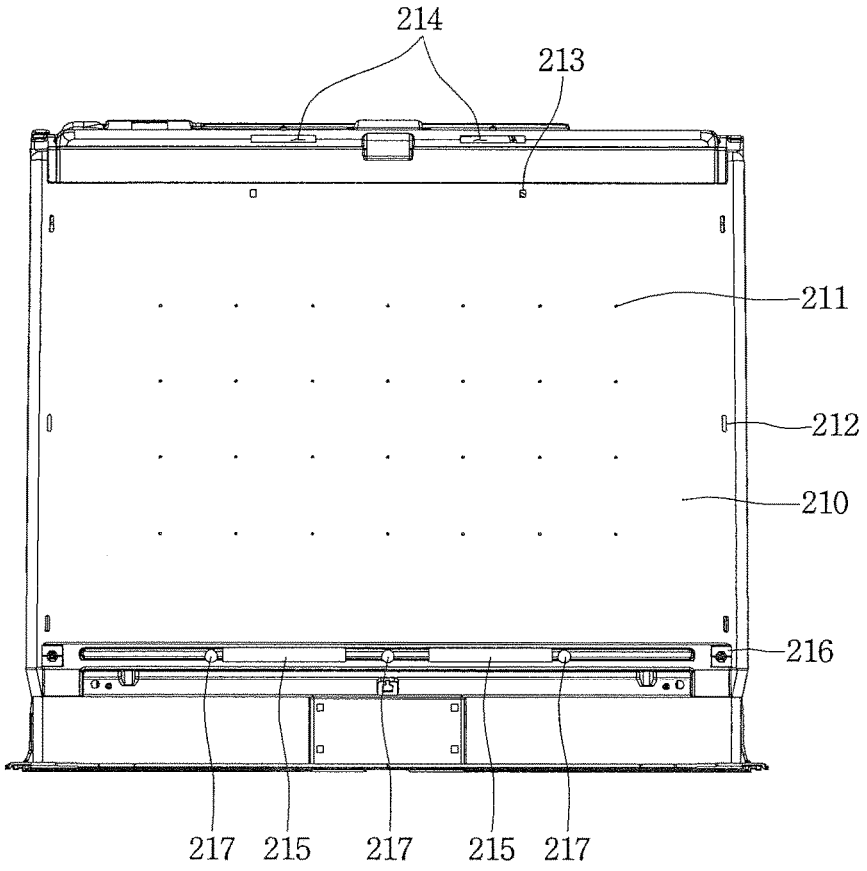
FIG. 10 is a top view of an example inner case in a main body of the refrigerator.
Figure 11:
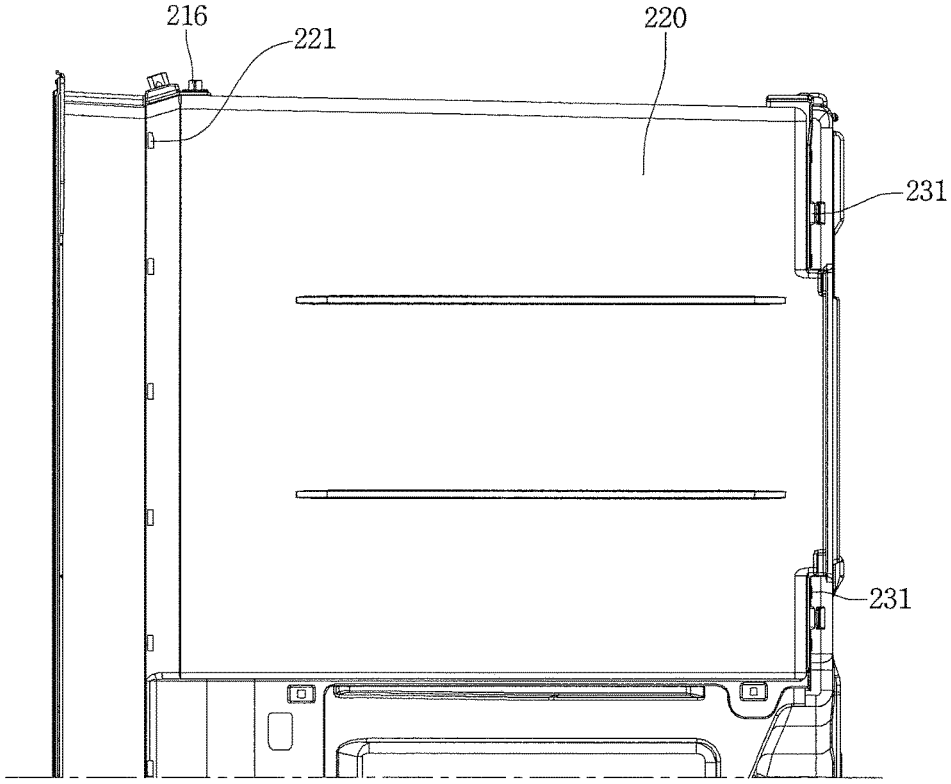
FIG. 11 is a side cross-sectional view of an example inner case in a main body of a refrigerator.
Figure 12:
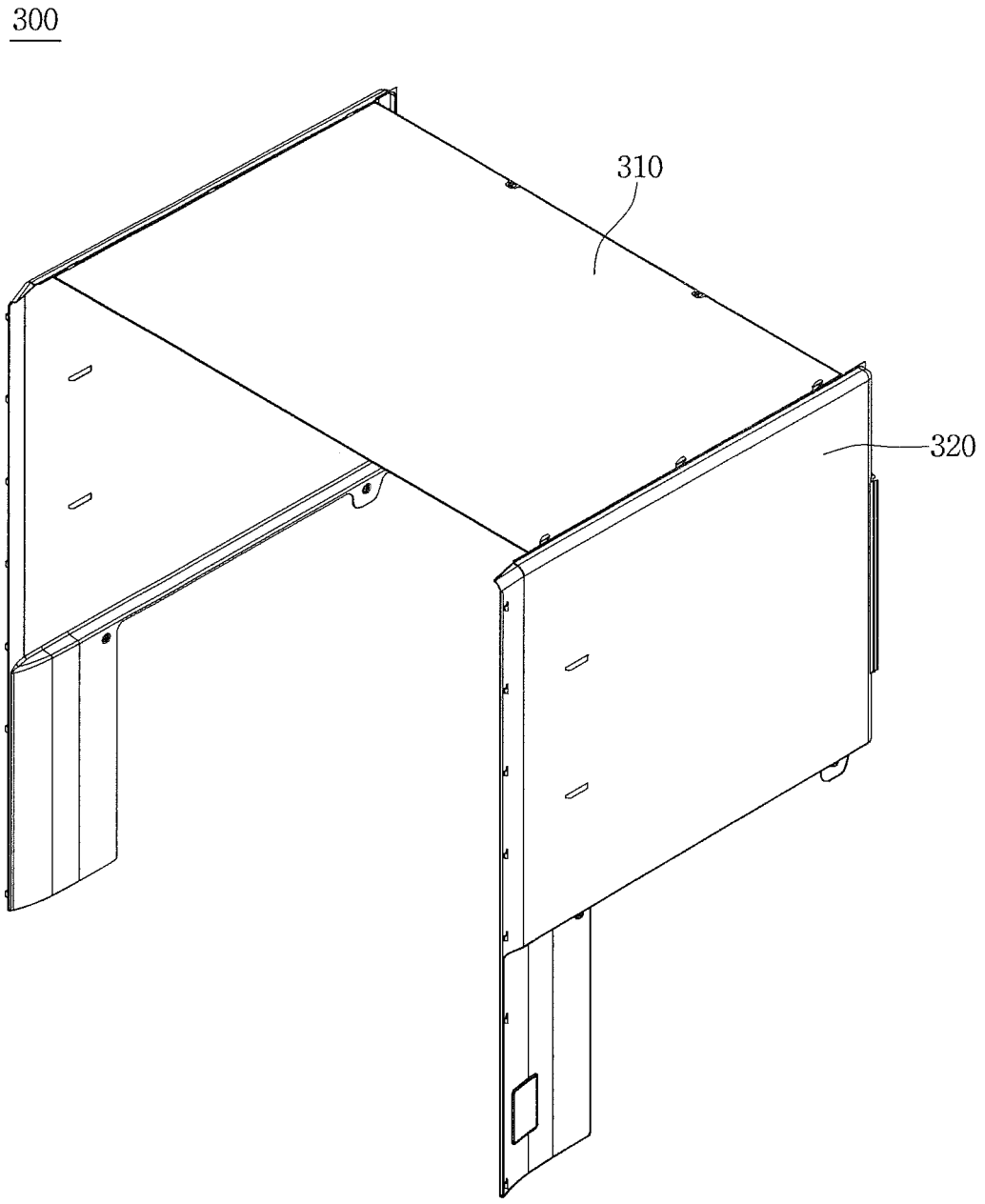
FIG. 12 is a perspective view of an example metal plate in a main body of a refrigerator.
Figure 13:
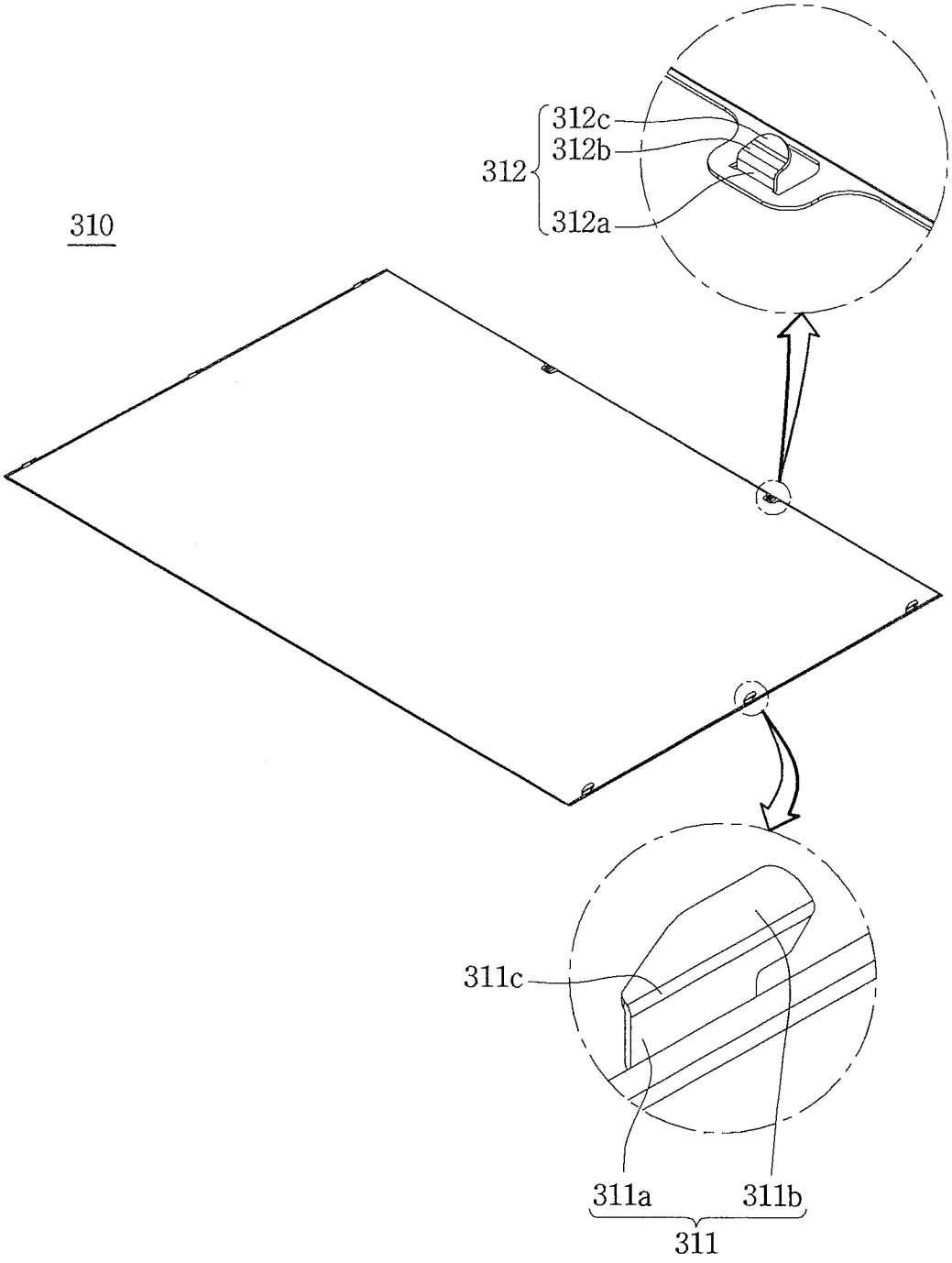
FIG. 13 is a perspective view of an example upper plate in a metal plate.
Figure 14:
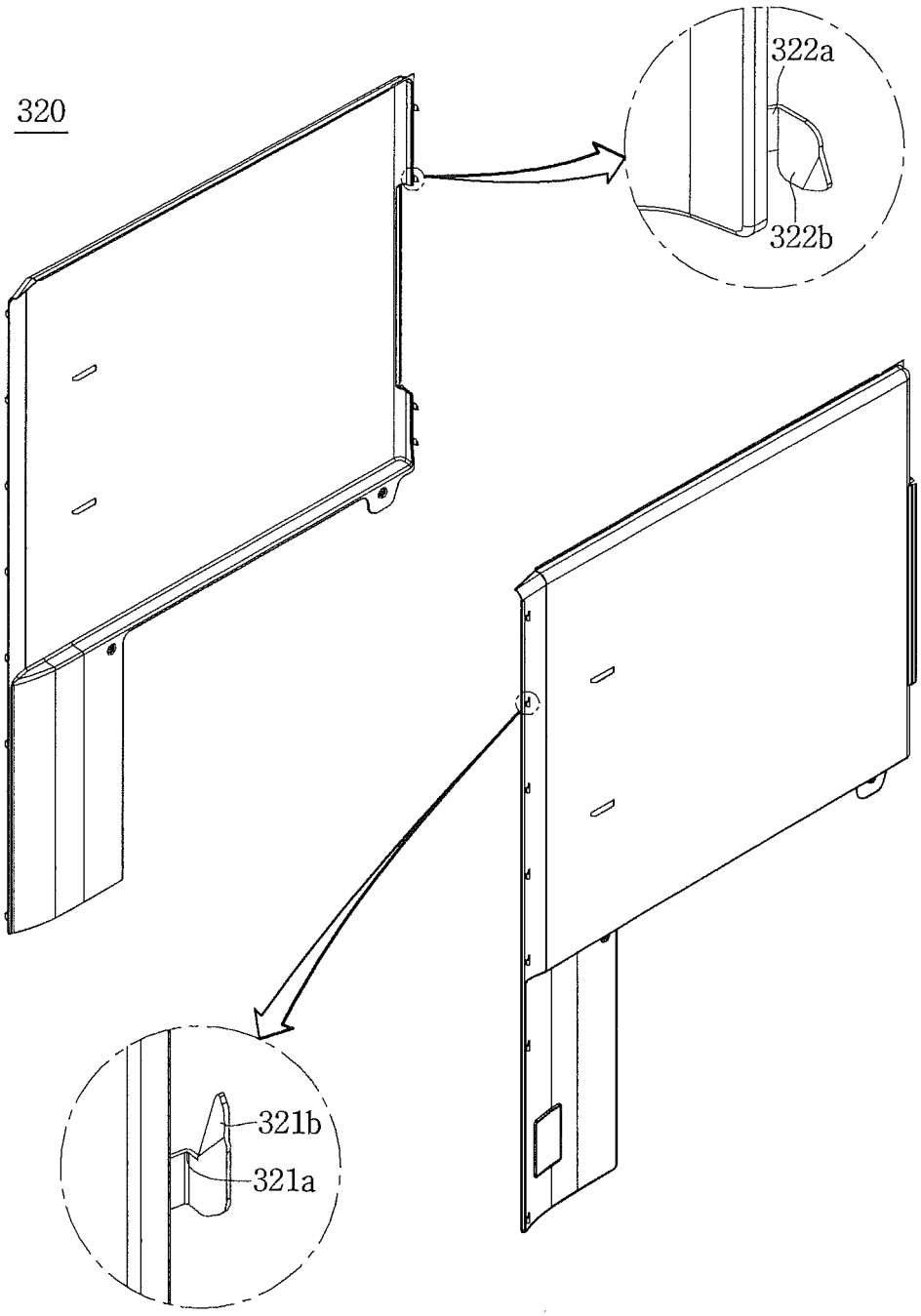
FIG. 14 is a perspective view of an example side plate in a metal plate.

FIGS. 9-11 illustrate example inner cases of a main body of a refrigerator. FIG. 12 illustrates an example metal plate of a main body of a refrigerator. FIG. 13 illustrates an example upper plate of a metal plate. FIG. 14 illustrates an example side plate of a metal plate.

Referring to FIGS. 3 to 5 and 9 to 14, the inner case 200 may be formed in the box shape of which the front surface is opened. In some implementations, the inner case 200 may include an upper surface portion 210 which forms an upper surface thereof, two side surface portions 220 which are bent downward and extend from both side ends of the upper surface portion 210, a rear surface portion 230 which is bent downward and extends from a rear end of the upper surface portion 210, and a lower surface portion 240 which connects lower ends of the two side surface portions 220 with a lower end of the rear surface portion 230.

Also, the metal plate 300 may include an upper plate 310 which is coupled to an inner surface of the upper surface portion 210, and two side plates 320 which are coupled to inner surfaces of the two side surface portions 220, respectively.

A plurality of coupling ribs 311, 312, 321 and 322 which are coupled into a plurality of coupling openings 212, 213, 221 and 232 formed at the inner case 200 may be formed at the upper plate 310 and the two side plates 320. Since, instead of openings, the plurality of coupling ribs 311, 312, 321 and 322 are formed at the metal plate 300 by bending protruding portions thereof, the openings of the metal plate 300 may be prevented from becoming rusty later due to the cooling air formed at the inside of the inner case 200 at which the metal plate 300 is installed.

The upper surface portion 210 may include a plurality of injection holes 211, a first coupling opening 212, a second coupling opening 213, one or more first duct coupling openings 215, one or more second duct coupling openings 214, a grille fixing portion 216 and a grille insertion hole 217.

Each of the plurality of injection holes 211 may be formed in an opening shape which passes through the upper surface portion 210, and a small amount of foaming agent may be injected therethrough. In some implementations, when the small amount of foaming agent is injected through the plurality of injection holes 211, a space between a lower surface of the upper surface portion 210 and an upper surface of the upper plate 310 may be filled with the foaming agent. Due to the foaming agent, the upper surface of the upper plate 310 may be uniformly attached to the lower surface of the upper surface portion 210.

Since the upper plate 310 is formed of a metallic material having a heavy weight, a center portion of the upper plate 310 may be sagged down due to gravity if the foaming agent is not provided. Therefore, by injecting the predetermined amount of foaming agent through the plurality of injection holes 211, the upper plate 310 may be firmly attached to the lower surface of the upper surface portion 210 without being sagged.

Also, the plurality of injection holes 211 may respectively have a size so that the foaming agent is not discharged to an outside when the small amount of foaming agent is injected therein. That is, each of the plurality of injection holes 211 may have the size in which the small amount of foaming agent injected into each of the plurality of injection holes 211 is prevented from being discharged again or leaking to the outside. Since the foaming agent has an adhesive material having predetermined viscosity, the foaming agent is not discharged again, as long as each of the plurality of injection holes 211 has a predetermined size.

Due to the plurality of injection holes 211, the foaming agent may maintain insulation of the inside of the refrigerator while being prevented from leaking to the outside, and may also firmly couple the upper plate 310 to the upper surface portion 210 of the inner case 200.

One or more first coupling openings 212 may be formed at both sides of the upper surface portion 210. In some implementations, the one or more first coupling openings 212 may be formed at both sides of an upper surface of the upper surface portion 210 to be spaced apart at a predetermined distance in a direction of a border of a side surface thereof. In some implementations, the first coupling opening 212 may be an opening which extends long from a front side toward a rear side.

One or more second coupling openings 213 may be formed at the rear end of the upper surface portion 210. In some implementations, the one or more second coupling openings 213 may be formed at the rear end of the upper surface of the upper surface portion 210 to be spaced apart at a predetermined distance in a direction of a border of the rear end thereof.

The one or more first duct coupling openings 215 may be formed at positions which are spaced apart from a front end of the upper surface portion 210 at a predetermined distance, and one ends 601 of the one or more upper ducts 600 may be coupled therein. In some implementations, the one or more first duct coupling openings 215 may be formed at positions, which are spaced apart from the front end of the upper surface portion 210 at the predetermined distance, so as to have shapes corresponding to those of the one ends 601 of the upper duct 600.

The one or more second duct coupling openings 214 may be formed at the rear end of the upper surface portion 210, and the other ends 602 of the one or more upper ducts 600 may be coupled therein. In some implementations, the one or more second duct coupling openings 214 may be formed at the rear end of the upper surface portion 210 to have shapes corresponding to those of the other ends 602 of the upper duct 600, such that the cooling air generated from the evaporator 700 in the inner case 200 is introduced therein.

In some implementations, the rear end of the upper surface portion 210 of the inner case 200 may include a first surface 210*a* which is parallel with the ground, an upper surface bending portion 210*b* which is bent down from the first surface 210*a*, and an upper surface rear end portion 210*c* which extends horizontally backward from the upper surface bending portion 210*b* and of which one end is connected to an upper end of the rear surface portion 230. In some implementations, the one or more second duct coupling openings 214 may be formed at a part of the upper surface rear end portion 210*c*.

The grille fixing portion 216 is disposed at a position of the upper surface which is spaced backward from the front end of the upper surface portion 210 at the first distance d, and has a groove formed at a lower portion thereof to provide a space in which the grille part 800 is fixed. In some implementations, one grille fixing portion 216 may be disposed at each of both side ends of the upper surface portion 210 which are spaced apart from the front end of the upper surface portion 210 at the first distance d, and may fix the grille part 800. In some implementations, the grille fixing portion 216 may be formed at a position which is spaced laterally from a portion, at which the one or more first duct coupling openings 215 are formed, at a predetermined distance.

The grille insertion hole 217 is an opening in which a part of the grille part 800 is inserted, and a plurality of grille insertion holes 217 may be formed at positions of the upper surface portion 210, which are spaced backward from the front end of the upper surface portion 210 at the first distance d, to be spaced apart along a border of the front end of the upper surface portion 210.

Detailed configuration in which the grille part 800 is coupled to the grille fixing portion 216 and the grille insertion hole 217 will be described.

Each of the two side surface portions 220 may include a third coupling opening 221 and a recessed portion 222.

One or more third coupling openings 221 may be formed at positions which are spaced apart from a front end of each of the two side surface portions 220. In some implementations, the one or more third coupling openings 221 may be formed at positions, which are spaced apart from the front end of each of the two side surface portions 220 at the first distance d, to be spaced apart at a predetermined distance along a border of the front end of each of the side surface portions 220, e.g., in a direction vertical to the ground.

The recessed portion 222 may be formed at a part of an inner surface of each of the two side surface portions 220. In some implementations, when each of the two side surface portions 220 is bent outward at a position which is spaced apart from the front end at the first distance d by a depth of a width of the side plate 320, and then bent backward again, and thus forms a space in which the side plate 320 is inserted, the recessed portion 222 is the space in which the side plate 320 is inserted.

The rear surface portion 230 may include a first coupling groove 231.

The first coupling groove 231 may be formed at a position of an inner surface of the rear surface portion 230 at which a part of a rear end of the side plate 320 is disposed. In some implementations, the first coupling groove 231 may be formed to be recessed backward and downward from an inner surface of the rear surface portion 230.

The upper plate 310 of the metal plate 300 may be coupled to the inner surface of the upper surface portion 210 at a position which is spaced apart from the front end of the upper surface portion 210 at the first distance d or more. In some implementations, the upper plate 310 may be a plate of which a length from a front end to a rear end is shorter than that of the upper surface portion 210 of the inner case 200 from the front end to the rear end. This is to prevent interference between the front end of the upper plate 310 and the refrigerator door when the refrigerator door is closed.

The upper plate 310 may include one or more first coupling ribs 311 and one or more second coupling ribs 312.

The first coupling ribs 311 may be formed in hook shapes which protrude upward from both sides of the upper surface of the upper plate 310. In some implementations, the number of first coupling ribs 311 may correspond to that of the first coupling openings 212.

Also, the first coupling ribs 311 may be formed to be spaced apart at a predetermined distance along borders of both side surfaces of the upper plate 310. In some implementations, the distance between the first coupling ribs 311 may be the same as that between the first coupling openings 212 formed at the upper surface portion 210.

In some implementations, the first coupling ribs 311 may include first protruding portions 311*a* which protrude upward from both sides of the upper plate 310, and first bending portions 311*b* which are bent backward from the first protruding portions 311*a*.

Also, each of the first bending portions 311*b* may be bent at a predetermined angle toward a center of the upper plate 310, and a first reinforcing portion 311*c* which protrudes in an extension direction of the first bending portion 311*b* to provide strength for preventing the first bending portion 311*b* from being bent may be formed at one surface of a bent portion of the first bending portion 311*b*. This is to enable the first coupling ribs 311 to be coupled into the first coupling openings 212, and also to enable the first bending portions 311*b* to be prevented from being bent while being installed or separated. Detailed description of a coupling configuration will be provided later.

The second coupling ribs 312 may protrude upward from the rear end of the upper surface of the upper plate 310, and may be formed in hook shapes having predetermined widths. Also, the number of second coupling ribs 312 may correspond to that of the second coupling openings 213, and may be formed to be spaced apart from each other in a predetermined distance along a border of the rear end of the upper plate 310. In some implementations, the distance between the second coupling ribs 312 may be the same as that between the second coupling openings 213 formed at the upper surface portion 210.

The second coupling ribs 312 may include second protruding portions 312*a* which protrude upward from the rear end of the upper plate 310, and second bending portions 312*b* and 312*c* which are bent backward from the second protruding portions 312*a*. The second bending portions 312*b* and 312*c* may be elastically deformed and fitted when the second coupling ribs 312 are inserted into the second coupling openings 213.

In some implementations, parts of the second bending portions 312*b* and 312*c* may include a plurality of bending portions. For example, the second bending portions 312*b* and 312*c* may be bent backward from the protruding portion at a predetermined angle (312*b*), and then may be bent upward again at a predetermined angle (312*c*). Due to the plurality of bending portions, the second bending portions 312*b* and 312*c* may be elastically deformed up and down using the first protruding portion 312*a* as an axis.

The two side plates 320 of the metal plate 300 may be coupled to the inner surfaces of the side surface portions 220 at positions which are spaced backward from front ends of the side surface portions 220.

In some implementations, each of the two side plates 320 may be formed so that a length thereof between a front end and a rear end is shorter than that of each of the side surface portion 220 of the inner case 200 between a front end and a rear end by the first distance d. This is to prevent interference between the front ends of the two side plates 320 and the refrigerator door when the refrigerator door is closed.

Each of the two side plates 320 may include one or more third coupling ribs 321 and one or more fourth coupling ribs 322.

The third coupling ribs 321 may be formed in hook shapes which protrude outward from one surface at which the side plate 320 is coupled to the side surface portion 220. In some implementations, the number of third coupling ribs 321 may correspond to that of third coupling openings 221. In some implementations, the third coupling ribs 321 may be formed to be spaced apart from a front end of one surface of the side plate 320 along a border of the front end of the side plate 320 at a predetermined distance. In some implementations, the distance between the third coupling ribs 321 may be the same as that between the third coupling openings 221 formed at the side surface portion 220.

In some implementations, each of the third coupling ribs 321 may include a third protruding portion 321*a* which protrudes outward from one surface of the side plate 320, and a third bending portion 321*b* which is bent upward from the third protruding portion 321*a*. Also, an upper portion of the third bending portion 321*b* may be bent toward a rear of the side plate 320 at a predetermined angle. Therefore, the third coupling rib 321 may be coupled into the third coupling opening 221, and also the third bending portion 321*b* may be prevented from being bent. A coupling relationship between the third coupling rib 321 and the third coupling opening 221 will be described later.

The fourth coupling rib 322 may protrude backward from the rear end of the side plate 320, and a part of the protruding portion may be bent laterally. In some implementations, the number of fourth coupling ribs 322 may correspond to that of the first coupling grooves 231. In some implementations, the fourth coupling ribs 322 may be formed to be spaced up and down from the rear ends of the side plates 320 at a predetermined distance. In some implementations, the distance between the fourth coupling ribs 322 may be the same as that between the first coupling grooves 231 formed at the inner surface of the rear surface portion 230.

In some implementations, the fourth coupling ribs 322 may include a fourth protruding portion 322*a* which protrudes backward from the rear end of the side plate 320, and a fourth bending portion 322*b* which is bent laterally from the fourth protruding portion 322*a*.

Also, a vertical length of the fourth bending portion 322*b* may be longer than that of the fourth protruding portion 322*a*. This is to prevent a portion of the fourth bending portion 322*b* which is longer than the vertical length of the fourth protruding portion 322*a* from interfering with an inner surface of the first coupling groove 231 while being inserted into the first coupling groove 231, and thus to prevent the portion of the fourth bending portion 322*b* from being separated toward the outside.

Also, a lower portion of the fourth bending portion 322*b* may be bent backward at a predetermined angle. Therefore, the fourth bending portion 322*b* may be coupled to the inner surface of the first coupling groove 231, and may also be prevented from being bent.

Hereinafter, a coupling relationship among the inner case, the metal plate and the grille part will be described in detail.

Figure 15:
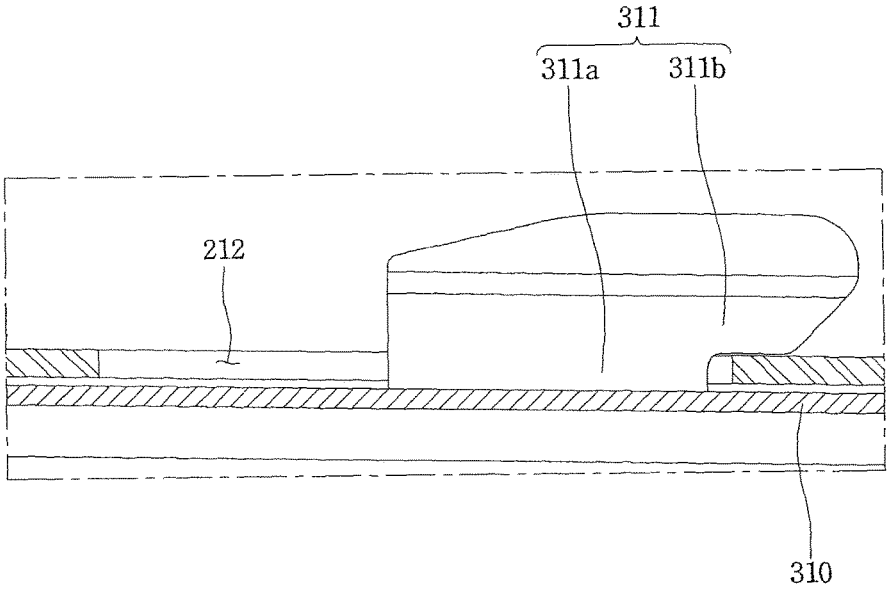
FIG. 15 is a side cross-sectional view of an example B portion of FIG. 5.
Figure 16:
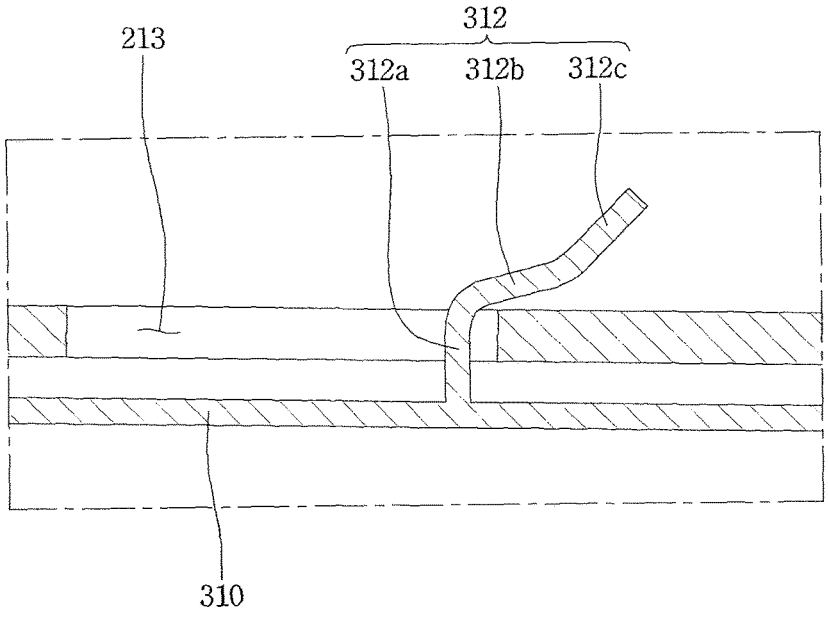
FIG. 16 is a side cross-sectional view of an example C portion of FIG. 5.
Figure 17:
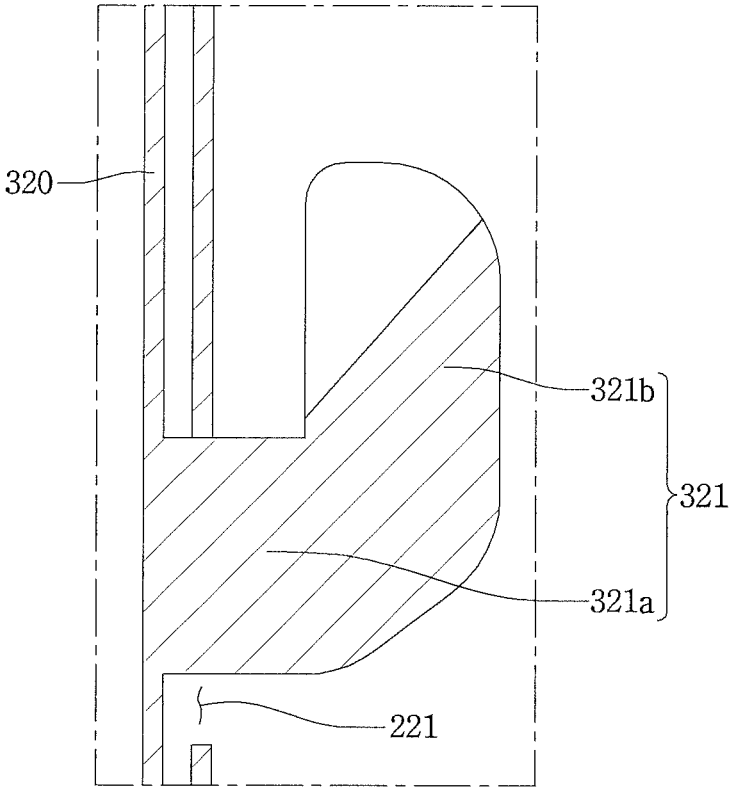
FIG. 17 is a front cross-sectional view of an example D portion of FIG. 5.
Figure 18:
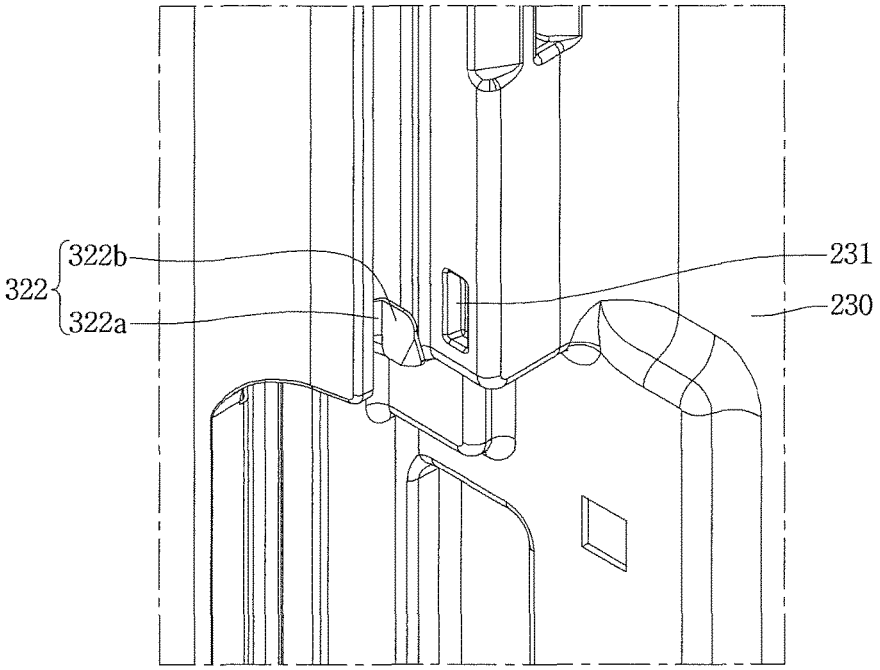
FIG. 18 is a view of an example A portion of FIG. 3 before being coupled.
Figure 19:
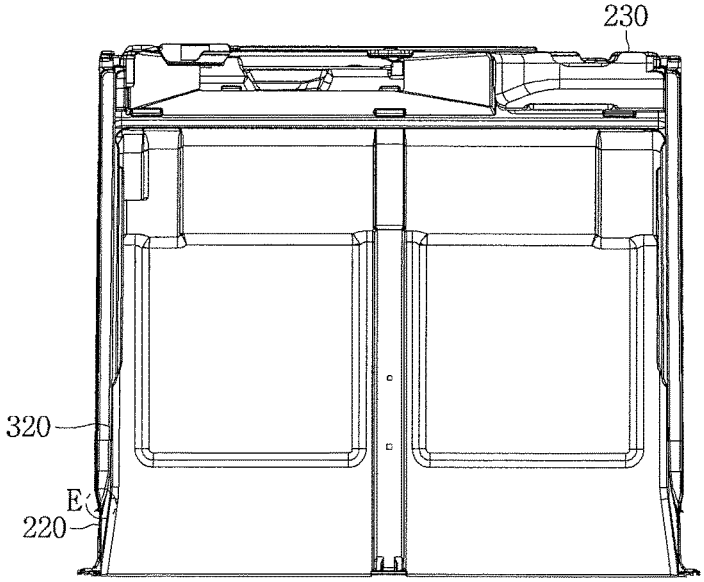
FIG. 19 is a top cross-sectional view of an example main body.
Figure 20:
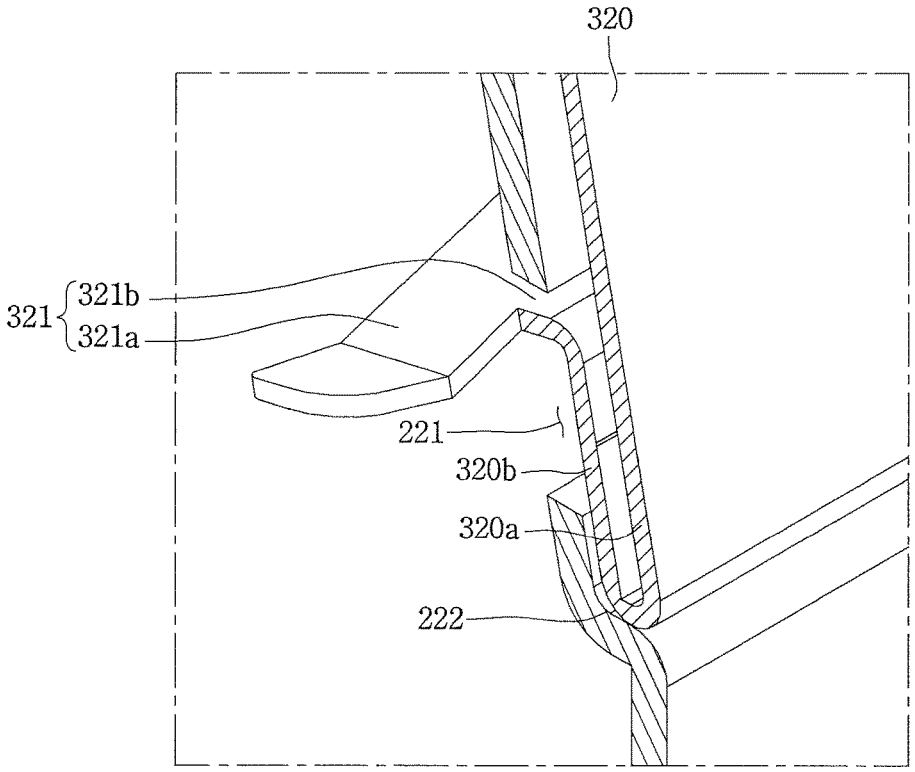
FIG. 20 is an enlarged view of an example E portion of FIG. 19.
Figure 21:
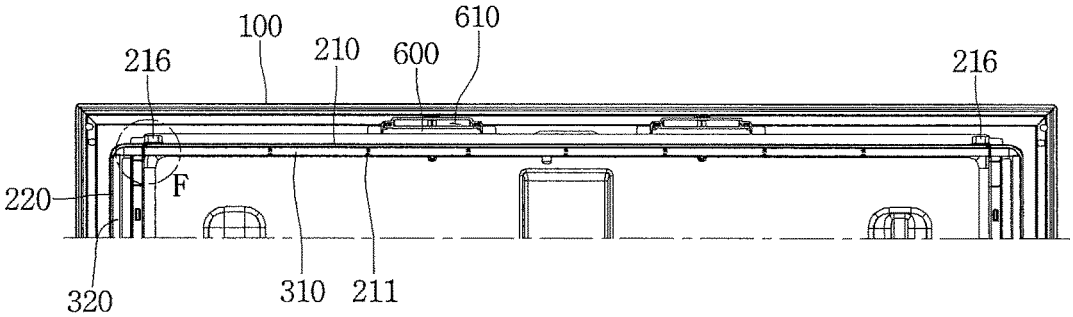
FIG. 21 is a cross-sectional view of an example a-a' portion of FIG. 8.
Figure 22:
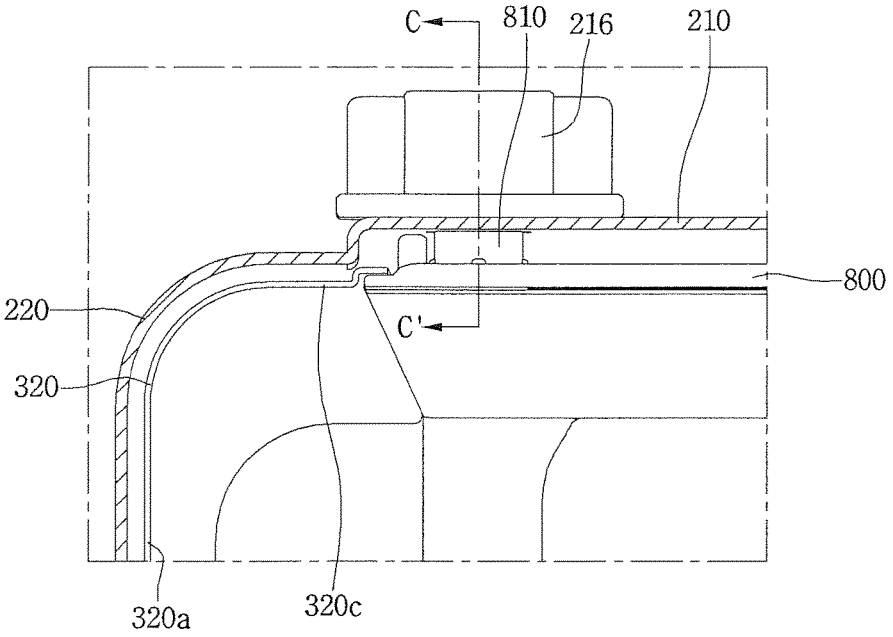
FIG. 22 is an enlarged view of an example F portion of FIG. 21.

FIG. 15 illustrates an example B portion of FIG. 5. FIG. 16 illustrates an example C portion of FIG. 5. FIG. 17 illustrates an example D portion of FIG. 5. FIG. 18 illustrates an example A portion of FIG. 3. FIG. 19 illustrates an example main body. FIG. 20 illustrates an example E portion of FIG. 19. FIG. 21 illustrates an example a-a' portion of FIG. 8. FIG. 22 illustrates an example F portion of FIG. 21.

Figure 23:
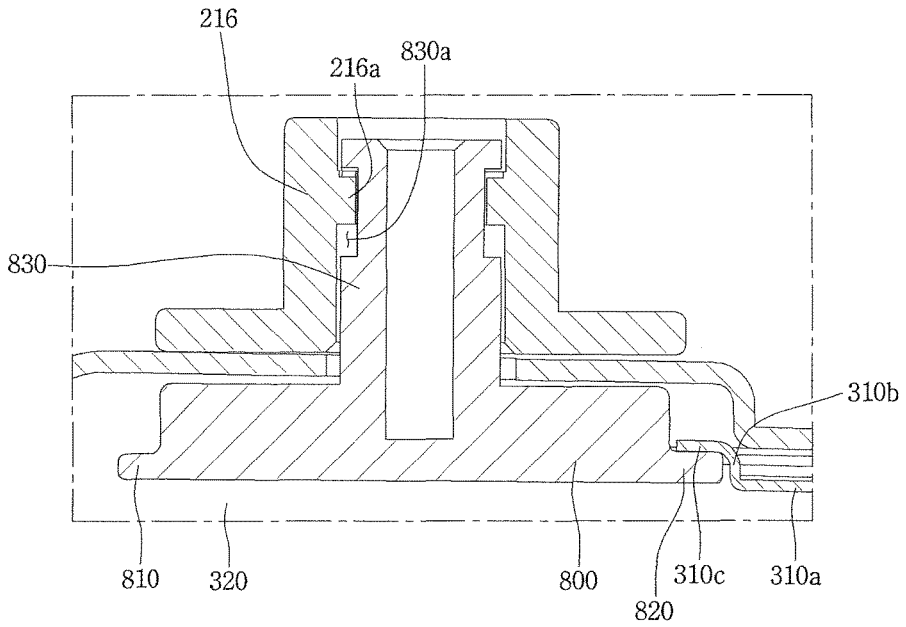
FIG. 23 is a side cross-sectional view of an example c-c' portion of FIG. 22.
Figure 24:
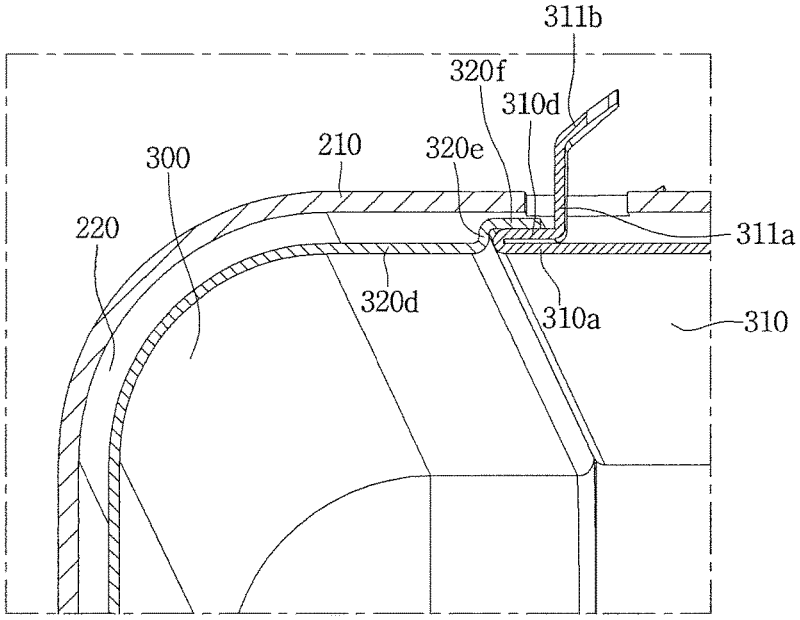
FIG. 24 is a cross-sectional view of an example b-b' portion FIG. 8.

FIG. 23 illustrates an example c-c' portion of FIG. 22. FIG. 24 illustrates an example b-b' portion of FIG. 8.

Referring to FIGS. 15 to 24, to couple the upper plate 310 of the metal plate 300 to the lower surface of the upper surface portion 210 of the inner case 200, when the upper plate 310 is pushed upward while being disposed at the lower surface of the upper surface portion 210, the one or more first coupling ribs 311 formed at the upper plate 310 are inserted into the one or more first coupling opening 212, respectively.

In some implementations, since the first bending portion 311*b* of the first coupling rib 311 is bent toward the center of the upper plate 310 at the predetermined angle, the first bending portion 311*b* may be inserted into the first coupling opening 212 through a bent inclined surface even when the first bending portion 311*b* interferes with the first coupling opening 212.

The second bending portions 312*b* and 312*c* of the one or more second coupling ribs 312 are pressed by the lower surface of the upper surface portion 210, and thus temporarily elastically deformed downward.

In this state, when the upper plate 310 is pushed backward, the first bending portions 311*b* of the first coupling ribs 311 are supported by a part of the upper surface of the upper surface portion 210, and the second bending portions 312*b* of the second coupling ribs 312 are fitted to the second coupling openings 213 while being elastically deformed upward, and thus the upper plate 310 is primarily coupled to the lower surface of the upper surface portion 210. In some implementations, the front end of the upper plate 310 is located at a position which is spaced apart from the front end of the upper surface portion 210 at the first distance d or more.

In this state, when the small amount of foaming agent is injected into each of the plurality of injection holes 211 formed at the upper surface portion 210, the foaming agent is injected into a space between the upper surface portion 210 and the upper plate 310, and the upper surface portion 210 and the upper plate 310 are secondarily coupled to each other.

Then, to couple the two side plates 320 to the inner surfaces of the two side surface portions 220 of the inner case 200, when the two side plates 320 are pushed toward the two side surface portions 220, the one or more third coupling ribs 321 formed at the front end of one surface of each of the side plates 320 are inserted into the one or more third coupling openings 221 formed at the front end of each of the side surface portions 220, respectively.

Also, the one or more fourth coupling ribs 322 formed at the rear end of each of the side plates 320 are inserted into the one or more first coupling grooves 231 formed at the inner surface of the rear surface portion 230, respectively, and thus the side plate 320 may be coupled to the side surface portions 220.

Also, lower ends of the side plates 320 may be supported by the partition wall which divides the refrigerator compartment and the freezer compartment in the inner case 200.

In some implementations, when the two side plates 320 are coupled to the two side surface portions 220, a lower surface of each of the third protruding portions 321*a* of the third coupling ribs 321 and one surface of each of the third bending portions 321*b* are in contact with an inner circumferential surface of each of the third coupling openings 221 and a part of other surface of each of the side surface portions 220, respectively, and bent portions of the fourth bending portions 322*b* of the fourth coupling ribs 322 are inserted into lower sides of the first coupling grooves 231, and thus the side plates 320 are supported by the side surface portions 220.

Then, upper ends of the two side plates 320 may be supported at lower sides thereof by both side ends of the upper plate 310, respectively. That is, the both side ends of the upper plate 310 may be in contact with a lower surface of each of the upper ends of the two side plates 320, and thus the upper plate 310 may support the side plates 320.

In some implementations, the upper plate 310 may include a first surface 310*a* which is disposed to be parallel with the upper surface portion 210 when being coupled to the upper surface portion 210 and shields the inner surface of the upper surface portion 210, and a side end portion 310*d* which is bent from both ends of the first surface 310*a* so as to be parallel with the first surface 310*a* and also to have an extension direction opposite to that of the first surface 310*a*. In some implementations, the first coupling rib 311 may be formed to extend upward from a distal end of the side end portion 310*d*.

Also, the side plate 320 may include a second surface 320*a* which is disposed to be parallel with the side surface portion 220 when being coupled to the side surface portion 220 and shields the inner surface of the side surface portion 220, and a upper end portion 320*c* which is bent from an upper end of the second surface 320*a* so as to correspond to the extending inner surfaces of the side surface portion 220 and the upper surface portion 210.

In some implementations, the upper end portion 320*c* may include a first upper end portion 320*d* which is bent orthogonally from the second surface 320*a* and is parallel with the upper surface portion 210, a second upper end portion 320*e* which is bent upward from one end of the first upper end portion 320*d*, and a third upper end portion 320*f* which extends from the second upper end portion 320*e* in an extension direction of the first upper end portion 320*d* so as to be parallel with the first upper end portion 320*d*.

At this point, the side end portion 310*d* of the upper plate 310 is disposed at a bending portion at which the third upper end portion 320*f* and the second upper end portion 320*e* are connected with each other, and thus the both side ends of the upper plate 310 may support the upper ends of the side plates 320 while the side end portion 310*d* supports a lower surface of the third upper end portion 320*f*.

Also, the grille part 800 may be disposed so that the rear end 820 is connected to the front end of the upper plate 310, and the front end 810 is connected to a front end of the inner case 200.

In some implementations, the first grille protrusion portions 830 formed to protrude upward from upper surfaces of both sides of the grille part 800 may be respectively fitted to the grille fixing portions 216 disposed at the positions of the upper surfaces of both side ends which are spaced backward from the front end of the inner case 200 at the first distance d and having the groove formed at the lower portion thereof.

In some implementations, a first groove 830*a* which is recessed inward may be formed at a part of an outer surface of each of the first grille protrusion portions 830, and a first protrusion 216*a* which has a shape corresponding to the first groove 830*a* may be formed at a groove formed at each of the grille fixing portions 216, e.g., a part of an inner surface of each of the grille fixing portions 216.

In some implementations, when the first grille protrusion portions 830 are fitted to the inner surfaces of the grille fixing portions 216, the first protrusions 216*a* are inserted into the first grooves 830*a*, and the first grille protrusion portions 830 are fixed to the grille fixing portions 216, and thus the grille part 800 may be coupled to the lower surface of the upper surface portion 210.

Also, the plurality of second grille protrusion portions 840 disposed between the two first grille protrusion portions 830 to be spaced apart at the regular intervals in a direction of a border of a front end of the grille part 800 are inserted into the plurality of grille insertion holes 217 formed at the upper surface portion 210 of the inner case 200, respectively, and thus the grille part 800 may be firmly fixed to the lower surface of the upper surface portion 210.

A vertical gap may be formed between the rear end 820 of the grille part 800 and the lower surface of the upper surface portion 210, and the front end of the upper plate 310 may be in contact with and supported by an upper surface of the rear end 820 of the grille part 800.

Also, the upper plate 310 may include the first surface 310*a*, a first extending portion 310*b* which is bent upward and extends from a front end of the first surface 310*a*, and a first front end portion 310*c* which is bent forward from the first extending portion 310*b* to be parallel with the first surface 310*a*.

In some implementations, the first front end portion 310*c* may be disposed at a spaced space between the rear end 820 of the grille part 800 and the lower surface of the upper surface portion 210. In some implementations, a lower surface of the first front end portion 310*c* may be seated on the upper surface of the rear end 820 of the grille part 800, and may be supported by the rear end 820 of the grille part 800.

In brief, the side plates 320 are coupled to the side surface portions 220 by the third coupling ribs 321 and the fourth coupling ribs 322, and the lower ends thereof are seated on the partition wall, and the upper ends thereof are seated on and supported by the both side ends of the upper plate 310. Accordingly, the side plates 320 may be firmly coupled to the side surface portions 220, and may be prevented from being spaced by a load due to a weight of the metallic material.

Also, since the upper plate 310 is coupled to the upper surface portion 210 of the inner case 200 by the first coupling ribs 311, the second coupling ribs 312 and the foaming agent injected through the injection holes 211, and the front end thereof is seated on and supported by the rear end 820 of the grille part 800, the upper plate 310 may be firmly coupled to the upper surface portion 210, and may be prevented from being spaced or sagged by the load due to a weight of the metallic material. That is, the metal plate 300 may be in close contact with the inner surface of the inner case 200 by the coupling and the supporting.

In addition, the recessed portion 222 which is recessed so that each of the side plates 320 is inserted therein when the side plates 320 are coupled may be formed at the inner surface of each of the two side surface portions 220.

In some implementations, a recessed depth of the recessed portion 222 may be the same as a width of each of the side plates 320. In some implementations, the side plates 320 may be coupled to the side surface portions 220 while being inserted into the recessed portions 222 of the side surface portion 220.

In some implementations, each of the side plates 320 may include a second front end portion 320*b* which is bent from the second surface 320*a* in a direction opposite to an extension direction of the second surface 320*a* so as to be parallel with the second surface 320*a*.

When the side plates 320 are coupled to the inner surfaces of the side surface portions 220, an inner surface of the recessed portion 222 is in contact with one surface of the second front end portion 320*b*, and a space corresponding to a width of the second front end portion 320*b* is formed between the side plate 320 and the side surface portion 220. The space formed between the side plate 320 and the side surface portion 220 may be filled later with the foaming agent.

Since the side plate 320 is inserted into the recessed portion 222, and coupled to the side surface portion 220, the inner surface of the side surface portion 220 and the inner surface of the side plate 320 may extend smoothly without any bent portions or spaced portions. Therefore, the side plates 320 and the side surface portions 220 look as if being integrally formed with each other.

Until now, the coupling relationship among the inner case, the metal plate and the grille part has been described. Hereinafter, a coupling relationship among the inner case, the upper duct and the rear duct will be described.

Figure 25:
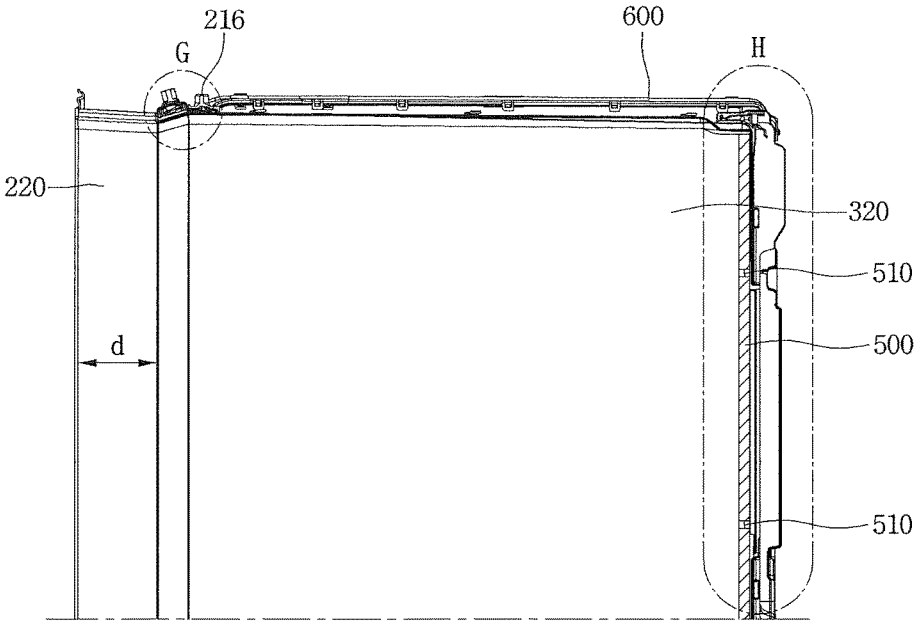
FIG. 25 is a view of an example flow path in a refrigerator.
Figure 26:
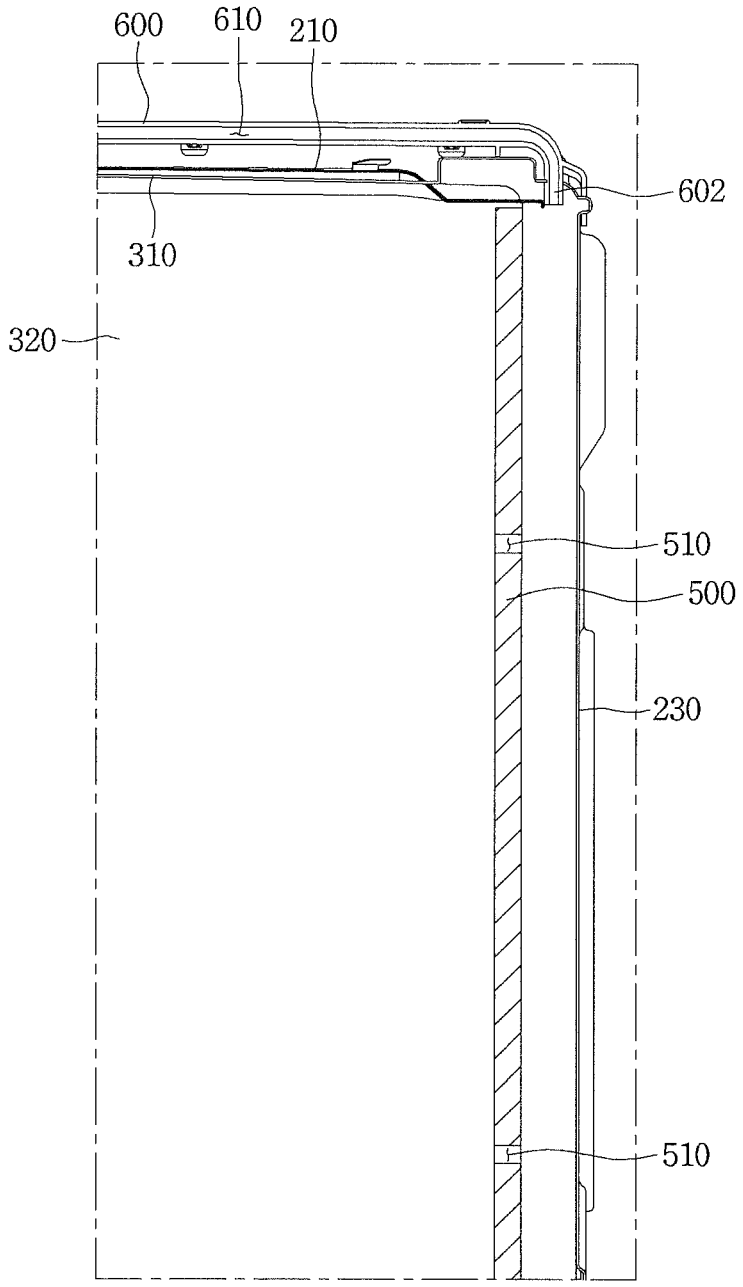
FIG. 26 is an enlarged view of an example G portion of FIG. 25.
Figure 27:
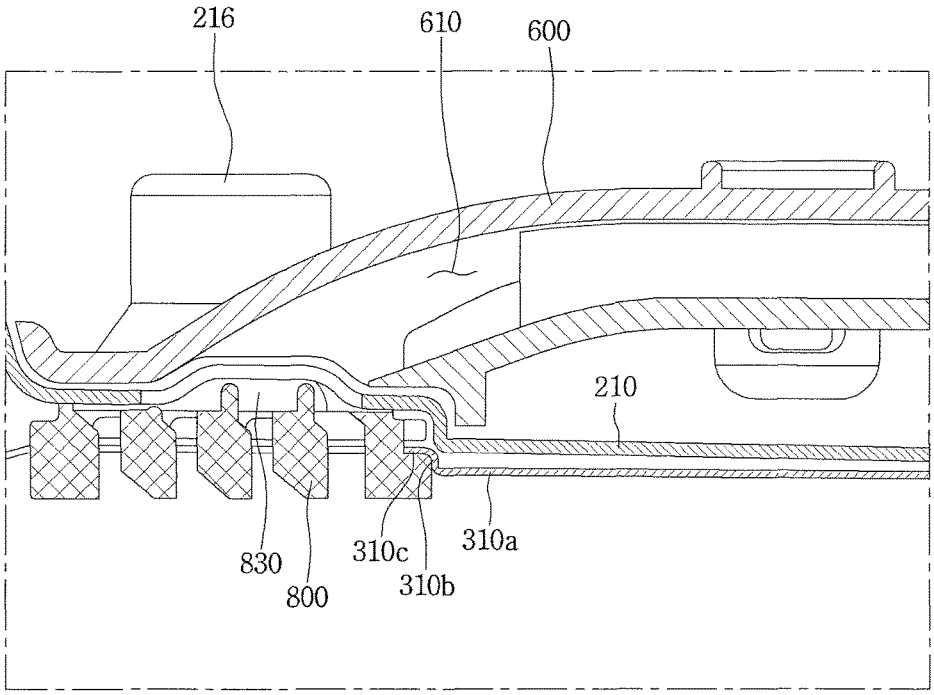
FIG. 27 is an enlarged view of an example H portion of FIG. 25.

FIG. 25 illustrates an example flow path in a refrigerator. FIG. 26 illustrates an example G portion. FIG. 27 illustrates an example H portion.

Referring to FIGS. 2, 7 and 25 to 27, the one end 601 of the upper duct 600 may be coupled to the first duct coupling opening 215 formed at the upper surface portion 210 of the inner case 200, and the other end 602 thereof may be coupled to the second duct coupling opening 214.

When the upper duct 600 is coupled to the upper surface portion 210, since a path extending from the one end 601 to the other end 602 is formed in the upper duct 600, the cooling air may flow from the second duct coupling opening 214 to the first duct coupling opening 215 through the path.

Also, the grille part 800 may be disposed at a lower side of the first duct coupling opening 215 and the second duct coupling opening 214 to which the one end 601 of the upper duct 600 is coupled. Detailed configuration in which the grille part 800 is coupled to the upper surface portion 210 of the inner case 200 has been already described, and thus will be omitted. Therefore, the cooling air guided from the second duct coupling opening 214 to the first duct coupling opening 215 may be supplied to the inside of the refrigerator through the grille part 800.

Also, the rear duct 500 may have a plate shape which is parallel with the rear surface portion 230 of the inner case 200, and may be disposed to be spaced forward from the rear surface portion 230 at a predetermined distance.

In some implementations, the rear duct 500 may shield the inner surface of the rear surface portion 230 so as not to be seen from an outside, and may also provide a space, through which the cooling air flows, between the inner case 200 and the rear duct 500. Detailed configuration of the rear duct 500 has been already described, and thus will be omitted.

Hereinafter, a flow of the cooling air according to coupling of the inner case 200, the rear duct 500 and the upper duct 600 will be described.

The cooling air generated from the evaporator 700 is supplied to the space between the rear duct 500 and the inner case 200 by the multi-fan 900 disposed at the upper portion of the evaporator 700. Also, some of the cooling air supplied to the space between the rear duct 500 and the inner case 200 is discharged forward through the one or more discharge openings 510 formed at the rear duct 500, and thus supplied to the inside of the refrigerator.

Also, the remaining cooling air is moved to the second duct coupling opening 214 formed at the rear end of the upper surface portion 210 of the inner case 200, and then guided to the other end 602 of the upper duct 600 coupled to the second duct coupling opening 214.

The cooling air guided to the other end 602 of the upper duct 600 is guided to the one end 601 of the upper duct 600 through the path formed in the upper duct 600, and discharged into the refrigerator through the first duct coupling opening 215 to which the one end 601 of the upper duct 600 is coupled and the grille part 800.

That is, in the refrigerator, the cooling air may be doubly supplied from a rear and a front of the inside of the refrigerator, and the stored product accommodated at the refrigerator door may receive sufficiently the cooling air, and thus the freshness thereof may be maintained.

Hereinafter, when the metal plate is coupled to the inner case 200 in the refrigerator, an effect in which the front end of the metal plate is disposed at an area which is spaced backward from the front end of the inner case 200 at a first distance will be described. In some implementations, a rate of increase in an insulation load according to the first distance will be described.

Figure 28:
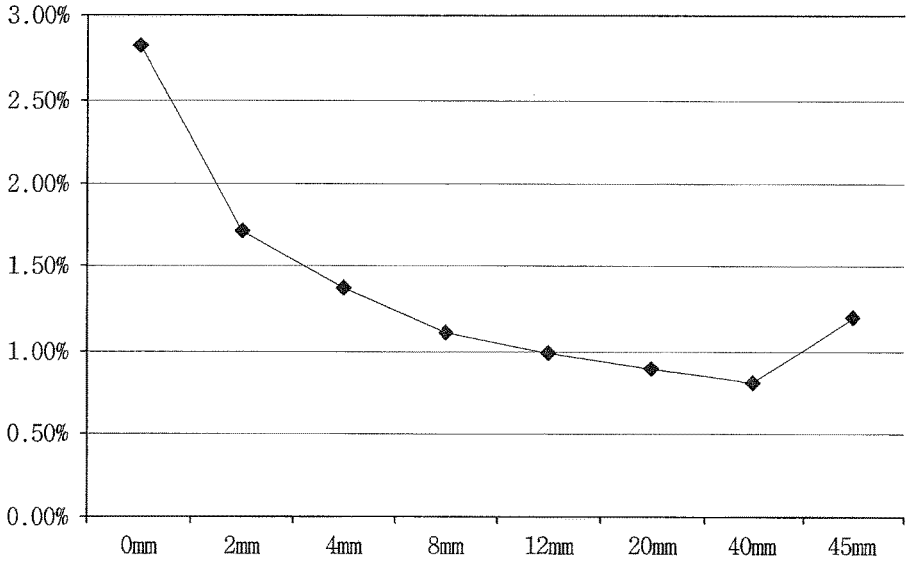
FIG. 28 is a graph of a rate of increase in an insulation load according to a distance between a front end of a metal plate and a front end of an inner case of a refrigerator.

FIG. 28 is a graph measuring the rate of increase in the insulation load according to a distance between the front end of the metal plate and the front end of the inner case of the refrigerator. An X axis in the graph is a length of the first distance, and a Y axis is a measured value of the rate of increase in the insulation load.

The rate of increase in the insulation load is a rate of increase in a load for insulating external heat or preventing the internal cooling air from leaking to an outside. As the rate of increase in the insulation load becomes lower, heat insulation capacity is increased.

Referring to the graph of FIG. 28, when the first distance d between the front end of the metal plate 300 and the front end of the inner case 200 is 0 mm, e.g., the front end of the metal plate 300 and the front end of the inner case 200 are disposed at the same position, an average rate of increase in the insulation load was 2.80%. However, when the first distance d is 2 mm, the average rate of increase in the insulation load was 1.70% which was lower than that in the same case.

That is, as the length of the first distance d increases, the average rate of increase in the insulation load decreased. Actually, when the length of the first distance d is 12 mm, the average rate of increase in the insulation load was 1% or less, and when the length of the first distance d is 40 mm, the average rate of increase in the insulation load was 0.75%.

Accordingly, when the refrigerator door is closed, the front end of the metal plate 300 is engaged with the refrigerator door as the distance between the front end of the metal plate 300 and the front end of the inner case 200 becomes narrower, and thus it may be confirmed that the cooling air preserved by the metal plate 300 leaks to the outside, and cooling efficiency of the refrigerator is degraded.

However, it may also be confirmed that the average rate of increase in the insulation load is increased again when the first distance d is 40 mm or more. In actual, it may be confirmed that the average rate of increase in the insulation load is more than 1.0% when the first distance d is 45 mm.

Such a result may be confirmed by a fact that, when the distance between the front end of the metal plate 300 and the front end of the inner case 200 is a predetermined distance or more, an area of the metal plate 300 is reduced, and thus an amount of the cooling air preserved by the metal plate 300 is also reduced, and the heat insulation capacity is maintained, but the amount of the cooling air in the refrigerator is reduced.

Therefore, it may be confirmed that the heat insulation capacity is the most excellent when the first distance d is 12 to 40 mm.

In the above description, the refrigerator including all of the elements has been described. However, various modifications in the refrigerator can be realized without departing from the technical spirit of the refrigerator, and each of the elements can also be independently used.

The refrigerator having the above-described configuration may have the following effects.

First, since the inside of the refrigerator is formed of a metallic material instead of a polymeric material, the inside of the refrigerator can be prevented from being stained or getting dirty while the user puts the stored product in the refrigerator or takes out the stored product therefrom, and also even when inside of the refrigerator is stained, the inside of the refrigerator can be cleaned.

Second, since the metal plate itself is coupled to the inside of the refrigerator, instead that the metal material is plated, the metal material is prevented from being scraped off, and the entire beauty in the refrigerator is enhanced, and luminous efficiency in the refrigerator is increased due to a light reflecting property of the metal plate.

Third, since, instead of openings, the plurality of coupling ribs which integrally protrude outward are formed at the metal plate, and fitted and coupled to the coupling openings formed at the inner case, the metal plate can be prevented from being rusty, or metal power can be prevented from falling down in the refrigerator.

Fourth, since the side plates of the metal plate coupled to the upper portion and the side surfaces of the inner case are supported by the both side ends of the upper plate, and the front end of the upper plate is supported by the grille part, an additional supporting force other than the coupling ribs for coupling the metal plates is formed, and the metal plate can be more firmly coupled to the inner case, and thus the metal plate can be prevented from falling down in the refrigerator.

Fifth, since the foaming agent is injected into each of the plurality of injection holes formed at the upper plate, the foaming agent is injected into the space between the upper plate and the inner case, and thus the cooling efficiency is increased, and also the center of the upper plate can be prevented from being sagged by the load due to its own weight.

Sixth, since the front end of the metal plate is spaced apart from the front end of the inner case, the refrigerator compartment door or the freezer compartment door can be prevented from interfering with the metal plate while being closed, and the cooling air preserved by the metal plate can also be prevented from being discharged to the outside. Therefore, the amount of the cooling air in the refrigerator is increased, and the heat insulation capacity of the refrigerator can be substantially increased, and thus the stored product stored in the refrigerator can be maintained to be fresh.

Seventh, since the duct is formed at the rear of the inner surface of the inner case, and the upper duct is additionally coupled to an upper portion of the inner case, the cooling air is doubly supplied from rear and upper sides of the inside of the refrigerator, and the cooling air is actively circulated in the refrigerator, and thus the stored product in the refrigerator can be stored freshly.

Even though all the elements of the implementations are coupled into one or operated in the combined state, the present disclosure is not limited to such an implementation. That is, all the elements may be selectively combined with each other without departing from the scope of the refrigerator. Furthermore, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

What is claimed is:

1. A refrigerator comprising:

an outer case;

an inner case that is located in the outer case and that defines a storage space, the inner case comprising:

a front portion that defines an opening to the storage space;

two side portions that each have recessed portions that are recessed in a direction from an inside of the inner case towards an outside of the inner case;

an upper portion that connects upper ends of the two side portions to each other and that defines:

one or more first coupling openings that are located at both side end portions of the upper portion; and one or more second coupling openings that are located at a rear end of the upper portion;

a rear portion that connects rear ends of the two side portions and the upper portion to each other;

a lower portion that connects lower ends of the two side portions and the rear portion to each other;

an upper plate that is coupled to an inner surface of the upper portion of the inner case and that comprises:

one or more first coupling ribs that protrude upward from both side ends of the upper plate; and one or more second coupling ribs that are located at a rear end of the upper plate and that protrude upward; and two side plates comprising:

a first side plate that is located in the recessed portion of one of the two side portions and coupled to the one of the two side portions; and a second side plate that is located in the recessed portion of the other of the two side portions and coupled to the other of the two side portions, wherein front ends of the two side plates are spaced apart from a front end of the inner case by a first distance, and wherein an inner surface of each of the two side plates and an inner surface of each of the two side portions of the inner case are smooth and define a single surface that forms a side surface of the storage space.

2. The refrigerator according to claim 1, wherein a front end of the inner case is spaced apart from the front end of the upper plate by the first distance of 12 to 40 mm.

3. The refrigerator according to claim 1, further comprising:

a grille part comprising:

a front end that is connected to the inner surface of the upper portion of the inner case; and a rear end that is connected to a front end of the upper plate.

4. The refrigerator according to claim 3, further comprising:

an evaporator that is located in the inner case and that is configured to generate cool air, wherein the grille part is spaced apart from a front end of the upper portion, and is configured to distribute the cool air generated by the evaporator to the inside of the inner case.

5. The refrigerator according to claim 4, wherein the upper plate comprises:

a first surface that is parallel to the upper portion of the inner case;

a first extending portion that is bent upward and that extends from a front end of the first surface; and a first front end portion that is bent forward from the first extending portion and that is parallel to the first surface, wherein a lower surface of the first front end portion is located on an upper surface of a rear end of the grille part such that the front end of the upper plate is supported by the grille part.

6. The refrigerator according to claim 5, further comprising:

a grille protrusion portion having a first groove formed on a part of an outer circumferential surface thereof, and extending upward from an upper surface of both side edge portions of the grille part, and a grille fixing portion coupled to the grille protrusion portion, the grille fixing portion having a first protrusion protruding from an inner circumferential surface thereof and configured to be inserted into the first groove.

7. The refrigerator according to claim 4, further comprising:

a rear duct that is located in front of the rear portion, that includes a surface that is separated from the rear portion, and that is configured to supply cool air generated by the evaporator to the storage space of the inner case; and one or more upper ducts that each include:

a first end that is coupled to an area spaced apart a distance from the front end of the upper portion; and a second end that is coupled to a rear end of the upper portion, wherein the one or more upper ducts define one or more paths for supplying cool air into the storage space of the inner case.

8. The refrigerator according to claim 7, wherein the upper portion defines:

one or more first duct coupling openings that are located at an area spaced apart a distance from the front end of the upper portion; and one or more second duct coupling openings that are located at the rear end of the upper portion and that are configured to receive cool air from the evaporator, wherein the first ends of the one or more upper ducts are coupled to the one or more first duct coupling openings, wherein the second ends of the one or more upper ducts are coupled to the one or more second duct coupling openings, and wherein the inner case receives cool air from the one or more second duct coupling openings, the one or more paths of the one or more upper ducts, and the one or more first duct coupling openings.

9. The refrigerator according to claim 8, wherein the grille part is located at a lower surface of the upper portion that defines the one or more first duct coupling openings, and is configured to receive cool air from the one or more first duct coupling openings.

10. The refrigerator according to claim 8, wherein the upper portion comprises:
an upper surface;
an upper surface bending portion that is connected to a rear end of the upper surface; and
an upper surface rear end portion that extends back and horizontally from the upper surface bending portion,
wherein an end of the upper surface rear end portion is connected to the rear portion, and
wherein the upper surface rear end portion defines the one or more second duct coupling openings.

11. The refrigerator according to claim 7, wherein the rear duct comprises a metallic material, and defines discharge openings that are configured to discharge cool air.

12. The refrigerator according to claim 1, wherein each of the two side plates comprises:
a surface that is parallel to the one of the side portions; and
a front end portion that is rewardly bent from a front end of the second surface and that is parallel to the second surface,
wherein, based on the side plates being coupled to the side portions, a surface of the second front end portion contacts an inner surface of the recessed portion.

13. A refrigerator comprising:
an outer case;
an inner case that is located in the outer case and that defines a storage space, the inner case comprising:
a front portion that defines an opening to the storage space;
two side portions;
an upper portion that connects upper ends of the two side portions to each other, that has a plurality of injection holes, and that defines:
one or more first coupling openings that are located at both side end portions of the upper portion; and
one or more second coupling openings that are located at a rear end of the upper portion;
a rear portion that connects rear ends of the two side portions and the upper portion to each other; and
a lower portion that connects lower ends of the two side portions and the rear portion to each other;
a foaming agent that fills a space between the outer case and the inner case, that is inserted through the plurality of injection holes, and that fills a space between the upper portion of the inner case and the upper plate;
an upper plate that is coupled to an inner surface of the upper portion of the inner case and that comprises:
one or more first coupling ribs that protrude upward from both side ends of the upper plate; and
one or more second coupling ribs that are located at a rear end of the upper plate and that protrude upward; and
two side plates that comprise:
a first side plate that is coupled to an inner surface of a first of the two side portions; and
a second side plate that is coupled to an inner surface of a second of the two side portions,
wherein the upper plate is attached to the upper portion of the inner case by the second foaming agent.

14. The refrigerator according to claim 13, wherein each of the plurality of injection holes is configured to receive the foaming agent and prevent discharge of a foaming agent.

15. The refrigerator according to claim 13, wherein both side ends of the upper plate are configured to support lower surfaces of upper ends of the two side plates.

16. The refrigerator according to claim 15, wherein the upper plate comprises:
a first surface that is parallel to the upper portion; and
side end portions that are outwardly bent at both side ends of the first surface and that are parallel to the first surface,
wherein each of the side plates comprises:
a second surface that is parallel to each of the side portions; and
an upper end portion that extends from an upper end of the second surface, and
wherein an upper surface of each of the side end portions supports a lower surface of the upper end portion.

17. The refrigerator according to claim 16, wherein the upper end portion of each of the side plates comprises:
a first upper end portion that extends from the second surface,
a second upper end portion that is upwardly bent at an end of the first upper end portion, and
a third upper end portion that is horizontally bent at an end of the second upper end portion and that is parallel to each side end portion of the upper plate,
wherein each of the side end portions supports a lower surface of the third upper end portion.

18. The refrigerator according to claim 13, wherein each of the one or more first coupling ribs comprises:
a first protruding portion that protrudes upward from both of the side ends of the upper plate; and
a first bending portion defines a bending angle with the first protruding portion, and
wherein the first protruding portion and the first bending portion define a predetermined angle toward a center of the upper plate.

19. The refrigerator according to claim 13, wherein each of the one or more second coupling rib comprises:
a second protruding portion that protrudes upward from the rear end of the upper plate; and
a second bending portion that defines a bending angle with the second protruding portion,
wherein a location between the second bending portion and the second protruding portion is flexible.

20. The refrigerator according to claim 13, further comprising:
one or more coupling openings that are located on each of the two side portions and are spaced apart from front ends of the two side portions a predetermined distance,
one or more first coupling grooves that are located on the rear portion, and
rear ends of the two side plates that are located at an inner surface of the rear portion,
wherein each of the side plates comprises:
one or more first coupling ribs that protrude from one surface of the side plate and that are spaced apart from a front end of the side plate a predetermined distance; and
one or more second coupling ribs that protrude backward from the rear end of the side plate.

21. The refrigerator according to claim 20, wherein each of the one or more third coupling ribs comprises:
a third protruding portion that protrudes outward from the front end of each of the side plates; and
a third bending portion that defines a bending angle with the third protruding portion,
wherein a part of the third bending portion defines a predetermined angle with a remaining part of the third bending portion.

22. The refrigerator according to claim 20, wherein each of the fourth coupling ribs comprises:

a fourth protruding portion that protrudes backward from the rear end of each of the side plates; and a fourth bending portion that extends from the fourth protruding portion and that is located in the first coupling groove, wherein the fourth bending portion defines a predetermined angle with the fourth protruding portion.

* * * * *